US011326122B2

(12) United States Patent
Perera et al.

(10) Patent No.: US 11,326,122 B2
(45) **Date of Patent: *May 10, 2022**

(54) FLUORINATED POLYACRYLATES ANTIFOAMS IN ULTRA-LOW VISCOSITY (<5 CST) FINISHED FLUIDS

(71) Applicant: The Lubrizol Corporation, Wickliffe, OH (US)

(72) Inventors: Sujith Perera, Twinsburg, OH (US); Kevin J. Hughes, Sammamish, WA (US); Elizabeth A. Schiferl, St. Paul, MN (US); David M. Nickerson, Concord Township, OH (US); Alonzo Smith, Bedford, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/982,188

(22) PCT Filed: Mar. 21, 2019

(86) PCT No.: PCT/US2019/023387
§ 371 (c)(1),
(2) Date: Sep. 18, 2020

(87) PCT Pub. No.: WO2019/183365
PCT Pub. Date: Sep. 26, 2019

(65) Prior Publication Data

US 2021/0024850 A1 Jan. 28, 2021

Related U.S. Application Data

(60) Provisional application No. 62/646,061, filed on Mar. 21, 2018.

(51) Int. Cl.

| | |
|---|---|
| ***C10M 147/04*** | (2006.01) |
| ***C10M 169/04*** | (2006.01) |
| *C10N 20/02* | (2006.01) |
| *C10N 20/04* | (2006.01) |
| *C10N 30/02* | (2006.01) |
| *C10N 30/06* | (2006.01) |
| *C10N 30/18* | (2006.01) |
| *C10N 40/04* | (2006.01) |
| *C10N 40/08* | (2006.01) |
| *C10N 40/25* | (2006.01) |

(52) U.S. Cl.
CPC ..... *C10M 147/04* (2013.01); *C10M 169/041* (2013.01); *C10M 2209/084* (2013.01); *C10M 2213/04* (2013.01); *C10M 2223/049* (2013.01); *C10M 2229/02* (2013.01); *C10N 2020/02* (2013.01); *C10N 2020/04* (2013.01); *C10N 2030/02* (2013.01); *C10N 2030/06* (2013.01); *C10N 2030/18* (2013.01); *C10N 2040/04* (2013.01); *C10N 2040/08* (2013.01); *C10N 2040/25* (2013.01)

(58) Field of Classification Search
CPC ..... C10M 147/04; C10M 169/04; C10M 2209/084; C10M 2213/04; C10N 2030/18
See application file for complete search history.

(56) References Cited

U.S. PATENT DOCUMENTS

| | | | | |
|---|---|---|---|---|
| 6,391,984 | B1 * | 5/2002 | Grolitzer | C10M 171/004 526/65 |
| 7,700,527 | B2 * | 4/2010 | Fang | C10M 147/04 508/469 |
| 2003/0092862 | A1 * | 5/2003 | Thomas | C08G 65/18 528/25 |
| 2007/0254819 | A1 * | 11/2007 | Fang | C10M 147/04 508/469 |
| 2009/0093384 | A1 * | 4/2009 | Ward | C10M 159/20 508/205 |
| 2019/0322959 | A1 * | 10/2019 | Knobloch | C10M 147/04 |
| 2020/0017794 | A1 * | 1/2020 | Knobloch | C08F 220/18 |

FOREIGN PATENT DOCUMENTS

| | | | | |
|---|---|---|---|---|
| EP | 1029030 | A1 | 8/2000 | |
| WO | WO-9920721 | A1 * | 4/1999 | B01D 19/0427 |
| WO | 2018057678 | A1 | 3/2018 | |
| WO | 2018118163 | A1 | 6/2018 | |

OTHER PUBLICATIONS

Written Opinion of the International Searching Authority, dated Jun. 24, 2019.
PCT International Search Report, dated Jun. 24, 2019.

* cited by examiner

*Primary Examiner* — Ellen M McAvoy
(74) *Attorney, Agent, or Firm* — Iken Sans; Teresan Gilbert; Elizabeth A Barks

(57) ABSTRACT

There is disclosed an antifoam component for a mechanical device which includes a poly(acrylate) copolymer. The antifoam component has improved foam performance in finished fluids utilizing dibutyl hydrogen phosphite compounds, such as driveline fluids. A lubricating composition comprising a) at least one oil of lubricating viscosity; and b) an antifoam component comprising a poly(acrylate) copolymer. The poly(acrylate) copolymer, b) may include (i) from about 30 wt % up to about 99 wt % of a (meth)acrylate monomer having $C_1$ to $C_4$ alkyl esters of (meth)acrylic acid; and (ii) from about 1 wt % up to about 70 wt % of a fluorinated (meth)acrylate monomer.

20 Claims, No Drawings

FLUORINATED POLYACRYLATES ANTIFOAMS IN ULTRA-LOW VISCOSITY (<5 CST) FINISHED FLUIDS

CROSS REFERENCE TO RELATED APPLICATION

This application claims priority from PCT Application Serial No. PCT/US2019/023387 filed on Mar. 21, 2019, which claims the benefit of U.S. Provisional Application No. 62/646,061 filed on Mar. 21, 2018.

BACKGROUND

The disclosed technology relates to compounds that are useful as antifoam components in lubricant compositions. In particular, lubricating compositions and concentrates comprising said antifoam components and the use of same are disclosed.

It is known to introduce antifoams into hydrocarbon oil formulations used in mechanical devices in order to alleviate foam tendencies of the hydrocarbon oil. Silicone-based antifoam agents comprising a polydimethylsiloxane as the principal ingredient belong to the class of the most widely used antifoam agents useful as a foam-breaking or foam-suppressing agents. While such silicone-based antifoam agents are effective at inhibiting foam in freshly formulated fluids, the materials readily depolymerize at increased temperatures in the presence of phosphite antiwear agents, oxidizers, or other catalyzing materials commonly found in hydrocarbon oil formulations, promoting foam.

Another source of silicon contamination can be from formed-in-place (FIP) gaskets. The benefits gained by manufacturers who use silicone formed-in-place liquid gaskets include: Ideal for sealing large gaps, highly flexible, can cope with scratched, damaged, or pitted metal surfaces, reduced inventory costs (no need to have a large stock of various shapes and sizes of pre-formed gaskets), and good adhesion to a wide variety of metals. During operation of a driveline device, however, low molecular weight Si-based oligomers can be released from the gasket binding materials. These low molecular weight Si-based oligomers can promote foam.

Additionally, as market usage of Group I base oils diminishes in favor of more refined base oils such as Group II, Group III, Group IV base oils, and Group V base oils, a need for more effective antifoam components arises.

There is a need for an antifoam component that can impart foam reduction while having equivalent antifoam performance in freshly blended fluids and improved thermal stability following heating of such fluids.

It is the objective of the invention to meet one or more of the needs described above.

SUMMARY OF THE INVENTION

The disclosed technology provides a lubricating composition comprising a) at least one oil of lubricating viscosity; and b) an antifoam component comprising a poly(acrylate) copolymer. The poly(acrylate) copolymer, b) may include (i) from about 30 wt % up to about 99 wt % of a (meth)acrylate monomer having $C_1$ to $C_4$ alkyl esters of (meth)acrylic acid; and (ii) from about 1 wt % up to about 70 wt % of a fluorinated (meth)acrylate monomer. The antifoam component may have a weight average molecular weight ($M_w$) of at least 1,000 Daltons. In another embodiment, the antifoam component, b) may include (i) from about 30 wt % up to about 99 wt % of a (meth)acrylate monomer having $C_1$ to $C_3$ alkyl esters of (meth)acrylic acid; and (ii) from about 1 wt % up to about 70 wt % of a fluorinated (meth)acrylate monomer; and may have a $M_w$ of at least 10,000 Daltons.

In another embodiment, the lubricating composition may comprise a) at least one oil of lubricating viscosity and b) an antifoam component comprising a poly(acrylate) copolymer. The poly(acrylate) copolymer, b) may include (i) from about 10 wt % up to about 60 wt % of a (meth)acrylate monomer having $C_1$ to $C_3$ alkyl esters of (meth)acrylic acid; and (ii) from about 2 wt % up to about 70 wt % of a fluorinated (meth)acrylate monomer; and (iii) from about 10 wt % up to about 70 wt % of a (meth)acrylate comonomer having $C_4$ to $C_{12}$ alkyl esters of (meth)acrylic acid. The antifoam component may have a $M_w$ of at least 1,000 Daltons. In another embodiment, the antifoam component, b) may include (i) from about 10 wt % up to about 60 wt % of a (meth)acrylate monomer having $C_1$ to $C_3$ alkyl esters of (meth)acrylic acid; and (ii) from about 20 wt % up to about 70 wt % of a fluorinated (meth)acrylate monomer; and (iii) from about 10 wt % up to about 60 wt % of a(meth)acrylate comonomer having $C_4$ to $C_8$ alkyl esters of (meth)acrylic acid and may have a $M_w$ of at least 10,000 Daltons. In any of the embodiments, the (meth)acrylate monomer (i) may comprise ethyl (meth)acrylate or propyl (meth)acrylate, or combinations thereof.

The at least one oil of lubricating viscosity may be a Group I oil, Group II oil, Group III oil, Group IV oil, Group V oil, or mixtures thereof. Alternatively, the at least one oil of lubricating viscosity is a Group I oil, Group III oil, Group IV oil, Group V oil, or mixtures thereof.

The lubricating composition may further comprise a phosphorus-containing anti-wear agent, a silicon-containing antifoam agent, or combinations thereof. The phosphorus-containing anti-wear agent may be dialkyl hydrogen phosphite. The silicon-containing anti-foam agent may be poly dialkylsiloxane. Accordingly, in one embodiment, the lubricating composition may further comprise dialkyl hydrogen phosphite, poly dialkylsiloxane, or combinations thereof. In another embodiment, the lubricating composition may comprise dialkyl hydrogen phosphite, poly dialkylsiloxane, and/or fluorinated poly dialkylsiloxane. In yet another embodiment, the dialkyl hydrogen phosphite is dibutyl phosphite.

The poly(acrylate) copolymer may comprise a fluorinated (meth)acrylate monomer that is branched or linear. Suitable fluorinated (meth)acrylate monomers include, but are not limited to, at least one of 2,2,2-trifluoroethyl (meth)acrylate, 1,1,1,3,3,-hexafluoroisopropyl (meth)acrylate, 2,2,3,3,4,4,5,5-octafluoropentyl (meth)methacrylate, 3,3,4,4,5,5,6,6,7,7,8,8,9,9,10,10,10-heptadecafluoroundecyl (meth)acrylate, 2,2,3,4,4,4-hexafluorobutyl (meth)acrylate, 3,3,4,4,5,5,6,6,7,7,8,8,8-tridecafluorooctyl (meth)acrylate, or combinations thereof.

In some embodiments the lubricating composition may comprise a poly(acrylate) copolymer including a (meth) acrylate monomer (i) that is ethyl acrylate and a fluorinated (meth)acrylate monomer (ii) that is 3,3,4,4,5,5,6,6,7,7,8,8,8-tridecafluorooctyl(meth)acrylate.

In some embodiments the antifoam component has a $M_w$ of from about 10,000 Da to about 350,000 Da, or about 10,000 to about 200,000 Da, or about 10,000 Da to about 120,000 Da. The antifoam component may be present in the lubricating composition in an amount of at least 1 ppm, 10 to 800 ppm, or 30 to 400 ppm.

In some embodiments, the lubricating composition may further comprise at least one additive that is a dispersant, viscosity modifier, friction modifier, detergent, antioxidant, seal swell agent, anti-wear agent, or combinations thereof. In yet other embodiments the lubricating composition may have a kinematic viscosity ("KV") at 100° C. of equal to or less than 5 cSt.

Methods of lubricating a mechanical device using a lubricating composition comprising a poly(acrylate) copolymer as described above are also disclosed. The mechanical device may be a driveline device, comprising an axle, a gear, a gearbox or a transmission. The mechanical device may also be an internal combustion engine. In yet other embodiments, the mechanical device may be a hydraulic system, a turbine system, a circulating oil system, a refrigeration lubricant system, or an industrial gear.

Methods of inhibiting or reducing foam in a mechanical device using a lubricating composition comprising a poly (acrylate) copolymer as described above are also disclosed. In some embodiments the mechanical device may have at least one silicon-containing gasket. The disclosed poly(acrylate) copolymer may also be used to increase the thermal and/or oxidation stability of a lubricating composition.

DETAILED DESCRIPTION OF THE INVENTION

Various preferred features and embodiments will be described below by way of non-limiting illustration. The disclosed technology provides a lubricating composition comprising a) at least one oil of lubricating viscosity; and b) an antifoam component comprising a poly(acrylate) copolymer. The poly(acrylate) copolymer, b) may include (i) from about 30 wt % up to about 99 wt % of a (meth)acrylate monomer having $C_1$ to $C_4$ alkyl esters of (meth)acrylic acid; and (ii) from about 1 wt % up to about 70 wt % of a fluorinated (meth)acrylate monomer.

As used herein, the term "poly(acrylate) copolymers" or "poly(acrylate) polymers" are polymers derived from monomers comprising alkyl esters of (meth)acrylic acids. Poly (acrylate) polymers and copolymers are commonly referred to as polyacrylates or acrylics. The terms "(meth)acrylic acid", "(meth)acrylate" and related terms include both acrylate and methacrylate groups, i.e. the methyl group is optional. For example, the term (meth) acrylic acid includes acrylic acid and methacrylic acid. Accordingly, in some embodiments, a (meth)acrylate or acrylate may comprise at least one acrylate, acrylic acid, methacrylate, methacrylic acid, or combinations thereof.

The poly(acrylate) polymer antifoam components disclosed herein can be prepared by methods generally known in the art. The polymerization may be affected in mass, emulsion or solution in the presence of a free-radical liberating agent as catalyst and in the presence or absence of known polymerization regulators. In one embodiment, the monomers can be polymerized in the presence of a solvent. The solvent may be aliphatic (such as heptanes) or aromatic (such as xylene or toluene). In another embodiment, the monomers can be polymerized in a hydrocarbon oil. In yet other embodiments, the monomers may be polymerized in light aromatic petroleum naphtha, heavy aromatic naphtha, or combinations thereof. When referring to a specified monomer(s) that is included in or used to prepare a poly (acrylate) copolymer disclosed herein, the ordinarily skilled person will recognize that the monomer(s) will be incorporated as at least one unit into the poly(acrylate) copolymer.

As used herein, $C_x$ to $C_y$, when used to describe the alkyl esters of (meth)acrylic acid, refers to the number of carbon atoms in the alkyl group connected to the oxygen on the (meth)acrylate moiety and does not include the number of carbon atoms in the (meth)acrylate moiety itself.

In some embodiments, the poly(acrylate) copolymer may comprise units with the structure of formula (I):

(I)

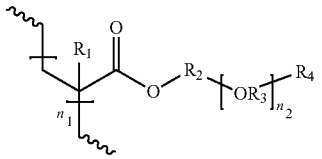

wherein $R^1$ is H or $CH_3$; $R^2$ is a $C_2$ to $C_{10}$ linear, branched, or cyclic hydrocarbyl group; $R^3$ is a $C_2$ to $C_4$ linear or branched hydrocarbyl group; $R^4$ is H, OH, or $CH_3$; $n_1$ is an integer ranging from 75 to 3000; and $n_2$ is an integer ranging from 0 to 3. In some embodiments, $R^2$ and/or $R^3$ is branched. In other embodiments, $R^2$ is linear and $R^3$ is branched.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group. In one embodiment, there are no halo substituents in the hydrocarbyl group.

The antifoam component may have a weight average molecular weight ($M_w$) of at least 1,000 Daltons. As used herein, the weight average molecular weight ($M_w$) is measured using gel permeation chromatography ("GPC") (Waters Alliance e2695) based on polystyrene standards. The instrument is equipped with a refractive index detector and Waters Empower™ data acquisition and analysis software. The columns are polystyrene/divinylbenzene (PLgel, (3 "Mixed-C" and one 100 Angstrom, 5 micron particle size), available from Agilent Technologies). For the mobile phase, individual samples are dissolved in tetrahydrofuran and filtered with PTFE filters before they are injected into the GPC port.

Waters Alliance e2695 Operating Conditions:
Column Temperature: 40° C.
Autosampler Control: Run time: 45 minutes
Injection volume: 300 microliter
Flow rate: 1.0 ml/minute
Differential Refractometer (RI) (2414): Sensitivity: 16; Scale factor: 20

Persons ordinarily skilled in the art will understand that the number average molecular weight ("$M_n$") may be measured using a similar technique to the one described above.

In another embodiment, the antifoam component, b) may include (i) from about 30 wt % up to about 99 wt % of a (meth)acrylate monomer having $C_1$ to $C_3$ alkyl esters of (meth)acrylic acid; and (ii) from about 1 wt % up to about 70 wt % of a fluorinated (meth)acrylate monomer; and may have a $M_w$ of at least 10,000 Daltons.

The fluorinated (meth)acrylate monomer can include esters of (meth)acrylic acids with linear or branched fluorinated alkanols. The fluorinated (meth)acrylate monomer can have three or more neighboring carbon atoms in the alkyl group which carry one or more fluorine atoms. In one embodiment the fluorinated (meth)acrylate monomers can include one or more of 2,2,2-trifluoroethyl (meth)acrylate, 1,1,1,3,3,-hexafluoroisopropyl (meth)acrylate, 2,2,3,3,4,4,5,5-octafluoropentyl (meth)methacrylate, 3,3,4,4,5,5,6,6,7,7,8,8,9,9,10,10,10-heptadecafluoroundecyl (meth)acrylate and tridecafluorooctyl (meth)acrylate, or 2,2,3,4,4,4-hexafluorobutyl (meth)acrylate.

In other embodiments, the (meth)acrylate monomer (i) may be present in an amount of about 40 wt % up to about 80 wt % and the fluorinated (meth)acrylate monomer (ii) may be present in an amount of about 20 wt % up to about 60 wt %. In any of these embodiments, the (meth)acrylate monomer (i) may comprise ethyl (meth)acrylate, propyl (meth)acrylate, or mixtures thereof.

In another embodiment, the lubricating composition may comprise a) at least one oil of lubricating viscosity and b) an antifoam component comprising a poly(acrylate) copolymer. The poly(acrylate) copolymer, b) may include (i) from about 10 wt % up to about 50 or 60 wt % of a (meth)acrylate monomer having $C_1$ to $C_3$ alkyl esters of (meth)acrylic acid; and (ii) from about 2 or 5 or 20 wt % up to about 50 or 70 wt % of a fluorinated (meth)acrylate monomer; and (iii) from about 10 or 20 wt % up to about 60 or 70 or 75 wt % of a (meth)acrylate comonomer having $C_4$ to $C_{12}$ or $C_4$ to $C_8$ alkyl esters of (meth)acrylic acid. The antifoam component may have a $M_w$ of at least 1,000 or at least 10,000 Daltons. In any of these embodiments, the (meth)acrylate monomer (i) may comprise ethyl (meth)acrylate or propyl (meth) acrylate, or combinations thereof.

The at least one oil of lubricating viscosity may be a Group I oil, Group II oil, Group III oil, Group IV oil, Group V oil, or mixtures thereof. Alternatively, the at least one oil of lubricating viscosity is a Group I oil, Group III oil, Group IV oil, Group V oil, or mixtures thereof. In yet other embodiments the lubricating composition may have a kinematic viscosity ("KV") at 100° C. of equal to or less than 5 cSt as measured using ASTM D445_100. In other embodiments, the lubricating composition may have a KV of about 3 to less than or equal to 5 cSt, or 3 to 5 cSt, or even 4 cSt.

The lubricating composition may further comprise a phosphorus-containing anti-wear agent, a silicon-containing antifoam agent, or combinations thereof.

The poly(acrylate) copolymer may comprise a fluorinated (meth)acrylate monomer that is branched or linear. Suitable fluorinated (meth)acrylate monomers include, but are not limited to, at least one of 2,2,2-trifluoroethyl (meth)acrylate, 1,1,1,3,3,-hexafluoroisopropyl (meth)acrylate, 2,2,3,3,4,4,5,5-octafluoropentyl (meth)methacrylate, 3,3,4,4,5,5,6,6,7,7,8,8,9,9,10,10,10-heptadecafluoroundecyl (meth)acrylate, 2,2,3,4,4,4-hexafluorobutyl (meth)acrylate, 3,3,4,4,5,5,6,6,7,7,8,8,8-tridecafluorooctyl (meth)acrylate, or combinations thereof.

In some embodiments the lubricating composition may comprise a poly(acrylate) copolymer including a (meth) acrylate monomer (i) that is ethyl acrylate and a fluorinated (meth)acrylate monomer (ii) that is 3,3,4,4,5,5,6,6,7,7,8,8,8-tridecafluorooctyl (meth)acrylate. In yet other embodiments the lubricating composition may comprise a poly (acrylate) copolymer including a (meth)acrylate monomer (i) that is ethyl acrylate, a fluorinated (meth)acrylate monomer (ii) that is 3,3,4,4,5,5,6,6,7,7,8,8,8-tridecafluorooctyl (meth)acrylate, and a (meth)acrylate comonomer (iii) that is 2-ethylhexyl acrylate.

In some embodiments the antifoam component has a $M_w$ of from about 10,000 Da to about 350,000 Da, or about 10,000 to about 200,000 Da, or about 10,000 Da to about 120,000 Da. The antifoam component may be present in the lubricating composition in an amount of at least 1 ppm, 10 to 800 ppm, or 30 to 400 ppm.

Phosphorus-Containing Anti-Wear Agents

Suitable phosphorus-containing anti-wear agents are not overly limited and can include at least one phosphorus acid, phosphorus acid salt, phosphorus acid ester or derivative thereof including sulfur-containing analogs. The phosphorus acids, salts, esters or derivatives thereof include phosphoric acid, phosphorous acid, phosphorus acid esters or salts thereof, phosphites, phosphorus-containing amides, phosphorus-containing carboxylic acids or esters, phosphorus-containing ethers, and mixtures thereof.

In one embodiment, the phosphorus acid, ester or derivative can be an organic or inorganic phosphorus acid, phosphorus acid ester, phosphorus acid salt, or derivative thereof. The phosphorus acids include the phosphoric, phosphonic, phosphinic, and thiophosphoric acids including dithiophosphoric acid as well as the monothiophosphoric, thiophosphinic and thiophosphonic acids. One group of phosphorus compounds are alkylphosphoric acid mono alkyl primary amine salts as represented by the formula

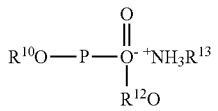

where $R^{10}$, $R^{12}$, $R^{13}$ are alkyl or hydrocarbyl groups or one of $R^{12}$ and $R^{12}$ can be H. The materials can be a 1:1 mixture of dialkyl and monoalkyl phosphoric acid esters. Compounds of this type are described in U.S. Pat. No. 5,354,484.

Other phosphorus-containing materials that may be present include dialkylphosphites (sometimes referred to as dialkyl hydrogen phosphonates) such as dibutyl phosphite. Yet other phosphorus materials include phosphorylated hydroxy-substituted triesters of phosphorothioic acids and amine salts thereof, as well as sulfur-free hydroxy-substituted di-esters of phosphoric acid, sulfur-free phosphorylated hydroxy-substituted di- or tri-esters of phosphoric acid, and amine salts thereof. These materials are further described in U.S. patent application US 2008-0182770.

The composition of the invention can include metal salts of a phosphorus acid such as metal salts of the formula

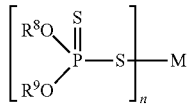

wherein $R^8$ and $R^9$ are independently hydrocarbyl groups containing 3 to 30 carbon atoms are readily obtainable by the reaction of phosphorus pentasulfide ($P_2S_3$) and an alcohol or phenol to form an O,O-dihydrocarbyl phosphorodithioic acid corresponding to the formula

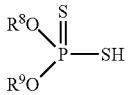

The metal M, having a valence n, generally is aluminum, lead, tin, manganese, cobalt, nickel, zinc, or copper, and in certain embodiments, zinc. The basic metal compound can thus be zinc oxide, and the resulting metal compound is represented by the formula

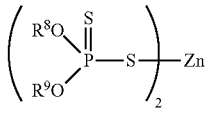

The R8 and R9 groups are independently hydrocarbyl groups that may be free from acetylenic and usually also from ethylenic unsaturation. They are typically alkyl, cycloalkyl, aralkyl or alkaryl group and have 3 to 20 carbon atoms, such as 3 to 16 carbon atoms or up to 13 carbon atoms, e.g., 3 to 12 carbon atoms. The alcohols which react to provide the R8 and R9 groups can be one or more primary alcohols, one or more secondary alcohols, a mixture of secondary alcohol and primary alcohol. A mixture of two secondary alcohols such as isopropanol and 4-methyl-2-pentanol is often desirable.

Such materials are often referred to as zinc dialkyldithiophosphates or simply zinc dithiophosphates. They are well known and readily available to those skilled in the art of lubricant formulation.

In one embodiment, the lubricating composition may comprise a phosphorus-containing anti-wear agent that is dialkyl hydrogen phosphite. The amount of phosphorus-containing anti-wear agents in a completely formulated lubricant, if present, will typically be 0.01 to 6 percent by weight, 0.01 to 5 percent by weight, or 0.03 to 2 percent by weight, or even 0.05 to 0.5 percent by weight. Its concentration in a concentrate will be correspondingly increased, to, e.g., 5 to 60 weight percent.

Anti-Foam Agents

Suitable anti-foam agents are not overly limited and can include silicones or organic polymers. Examples of these anti-foam compositions are described in "Foam Control Agents", by Henry T. Kerner (Noyes Data Corporation, 1976), pages 125-162. In one embodiment, the lubricating composition comprises a silicon-containing anti-foam agent such as polysiloxanes, poly dialkyl siloxanes, fluorinated polysiloxanes, or fluorinated poly dialkyl siloxanes. In one embodiment, the lubricating composition may comprise an anti-foam agent that is poly dialkylsiloxane. Additional anti-foam agents include copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers. The amount of silicon-containing anti-foam agent in a completely formulated lubricant, if present, will typically range from 40 ppm to 300 ppm (on an actives or diluent-free bases).

Accordingly, in some embodiments, the lubricating composition may further comprise dialkyl hydrogen phosphite, poly dialkylsiloxane, or combinations thereof. In another embodiment, the lubricating composition may comprise dialkyl hydrogen phosphite, poly dialkylsiloxane, and/or fluorinated poly dialkylsiloxane. In yet another embodiment, the dialkyl hydrogen phosphite is dibutyl phosphite. In some embodiments the lubricant composition will comprise 0.05 to 0.5 wt % of a phosphorus-containing anti-wear agent (such as dialkyl hydrogen phosphite) and 40 to 300 ppm of a poly dialkylsiloxane and/or fluorinated poly dialkylsiloxane.

Oil of Lubricating Viscosity

The present technology provides a composition which comprises, as one component, an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerized and interpolymerized olefins (e.g., polybutylenes, polypropylenes, propylene-isobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof.

Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid (GTL) synthetic procedure as well as other gas-to-liquid (GTL) oils.

GTL base oils include base oils obtained by one or more possible types of GTL processes, typically a Fischer-Tropsch process. The GTL process takes natural gas, predominantly methane, and chemically converts it to synthesis gas, or syngas. Alternatively, solid coal can also be converted into synthesis gas. Synthesis gas mainly contains carbon monoxide (CO) and hydrogen (H2), which are mostly subsequently chemically converted to paraffins by a catalytic Fischer-Tropsch process. These paraffins will have a range of molecular weights and by the use of catalysts can be hydroisomerised to produce a range of base oils. GTL base stocks have a highly paraffinic character, typically greater than 90% saturates. Of these paraffinics, the non-cyclic paraffinic species predominate over the cyclic paraffinic species. For example, GTL base stocks typically comprise greater than 60 wt %, or greater than 80 wt %, or greater than 90 wt % non-cyclic paraffinic species. GTL base oils typically have a kinematic viscosity at 100° C. of between 2 cSt and 50 cSt, or 3 cSt to 50 cSt, or 3.5 cSt to 30 cSt. The GTL exemplified in this instance has a kinematic viscosity at 100° C. of about 4.1 cSt. Likewise, the GTL base stocks are typically characterised as having a viscosity index (VI, refer to ASTM D2270) of 80 or greater, or 100 or greater, or 120 or greater. The GTL exemplified in this instance has a VI of 129. Typically, GTL base fluids have effectively zero sulphur and nitrogen contents, generally less than 5 ppm of each of these elements. GTL base stocks are Group III oils, as classified by the American Petroleum Institute (API).

Oils of lubricating viscosity may also be defined as specified in the American Petroleum Institute (API) Base Oil Interchangeability Guidelines. The five base oil groups are as follows: Group I (sulfur content>0.03 wt %, and/or <90 wt % saturates, viscosity index 80 to less than 120); Group II (sulfur content<0.03 wt %, and >90 wt % saturates, viscosity index 80 to less than 120); Group III (sulfur content<0.03 wt %, and >90 wt % saturates, viscosity index>120); Group IV (all polyalphaolefins (PAOs)); and Group V (all others not included in Groups I, II, III, or IV). The oil of lubricating viscosity may also be an API Group II+ base oil, which term refers to a Group II base oil having a viscosity index greater than or equal to 110 and less than 120, as described in SAE publication "Design Practice: Passenger Car Automatic Transmissions", fourth Edition, AE-29, 2012, page 12-9, as well as in U.S. Pat. No. 8,216,448, column 1 line 57.

The oil of lubricating viscosity may be an API Group IV oil, or mixtures thereof, i.e., a polyalphaolefin. Poly-alpha olefin base oils (PAOs), and their manufacture, are generally well known. With regards PAOs, the PAO base oils may be derived from linear C2 to C32, preferably C4 to C16, alpha olefins. Particularly preferred feedstocks for PAOs are 1-octene, 1-decene, 1-dodecene and 1-tetradecene. The polyalphaolefin may be prepared by metallocene catalyzed processes or from a non-metallocene process.

The oil of lubricating viscosity may comprise an API Group II, Group III, Group IV, Group V oil or mixtures thereof.

In one embodiment, the oil of lubricating viscosity is an API Group II, Group II+, Group III, Group IV oil or mixtures thereof. In another embodiment, the oil of lubricating viscosity is often an API Group II, Group II+, Group III oil or mixtures thereof.

In one embodiment, the oil of lubricating viscosity is a Group II, Group III, Group IV or Gas-to-Liquid (Fischer-Tropsch) oil, or mixtures thereof.

The amount of the oil of lubricating viscosity present is typically the balance remaining after subtracting from 100 wt % the amount of the compound of formula (I) and, when present, other performance additives.

The amount of the oil of lubricating viscosity present is typically the balance remaining after subtracting from 100 wt % the sum of the amount of the compound of the invention and the other performance additives. The amount of each chemical component or additive described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

The composition may be in the form of a concentrate or a fully formulated lubricant. If the composition is in the form of a fully formulated lubricant, typically the oil of lubricating viscosity, including any diluent oil present in the composition, will be present in an amount of from 70 to 95 wt %, or from 80 or 85 to 93 wt %.

If the lubricating composition of the invention is in the form of a concentrate (which may then be combined with additional oil to form, in whole or in part, a finished lubricant), typically the oil of lubricating viscosity, including any diluent oil present in the composition, will be present in an amount of from 0.1 wt % to 40 wt % or 0.2 wt % to 35 wt % or 0.4 wt % to 30 wt % or 0.6 wt % to 25 wt % or 0.1 wt % to 15 wt % or 0.3 wt % to 6 wt %.

In some embodiments, the compositions of the invention are lubricating compositions which can include an antifoam component in an amount of at least 50 ppm, or at least 100 ppm, or from 50 ppm to 1000 ppm, or from about 50 to about 500, or from 50 ppm to 450 ppm or 400 ppm of the overall composition on an oil free basis. The balance of these lubricating compositions may be one or more additional additives as described below and a major amount of oil of lubricating viscosity including any diluent oil or similar material carried into the composition from one or more of the components described herein. By major amount is meant greater than 50 wt % based on the composition.

Additional Additives

In some embodiments, the lubricating composition may further comprise at least one additive that is a dispersant, viscosity modifier, friction modifier, detergent, antioxidant, seal swell agent, anti-wear agent, or combinations thereof.

Dispersants

Dispersants are well known in the field of lubricants and include primarily what are sometimes referred to as "ashless" dispersants because (prior to mixing in a lubricating composition) they do not contain ash-forming metals and they do not normally contribute any ash forming metals when added to a lubricant. Dispersants are characterized by a polar group attached to a relatively high molecular weight hydrocarbon chain.

One class of dispersant is Mannich bases. These are materials which are formed by the condensation of a higher molecular weight, alkyl substituted phenol, an alkylene polyamine, and an aldehyde such as formaldehyde and are described in more detail in U.S. Pat. No. 3,634,515. Another class of dispersant is high molecular weight esters. These materials are similar to Mannich dispersants or the succinimides described below, except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022. Aromatic succinate esters may also be prepared as described in United States Patent Publication 2010/0286414. Other dispersants include polymeric dispersant additives, which are generally hydrocarbon-based polymers which contain polar functionality to impart dispersancy characteristics to the polymer.

In certain embodiments, the dispersant is prepared by a process that involves the presence of small amounts of chlorine or other halogen, as described in U.S. Pat. No. 7,615,521 (see, e.g., col. 4, lines 18-60 and preparative example A). Such dispersants typically have some carbocyclic structures in the attachment of the hydrocarbyl substituent to the acidic or amidic "head" group. In other embodiments, the dispersant is prepared by a thermal process involving an "ene" reaction, without the use of any chlorine or other halogen, as described in U.S. Pat. No. 7,615,521; dispersants made in this manner are often derived from high vinylidene (i.e., greater than 50% terminal vinylidene) polyisobutylene (see col. 4, line 61 to col. 5, line 30 and preparative example B). Such dispersants typically do not contain the above-described carbocyclic structures at the point of attachment. In certain embodiments, the dispersant is prepared by free radical catalyzed polymerization of high-vinylidene polyisobutylene with an ethylenically unsaturated acylating agent, as described in U.S. Pat. No. 8,067,347.

Dispersants may be derived from, as the polyolefin, high vinylidene polyisobutylene that is, having greater than 50, 70, or 75% terminal vinylidene groups (□ and □ isomers). In certain embodiments, a succinimide dispersant may be prepared by the direct alkylation route. In other embodiments, it may comprise a mixture of direct alkylation and chlorine-route dispersants.

A preferred class of dispersants is the carboxylic dispersants. Carboxylic dispersants include succinic-based dispersants, which are the reaction product of a hydrocarbyl substituted succinic acylating agent with an organic hydroxy compound or, in certain embodiments, an amine containing at least one hydrogen attached to a nitrogen atom, or a mixture of said hydroxy compound and amine. The term "succinic acylating agent" refers to a hydrocarbon-substituted succinic acid or succinic acid-producing compound. Such materials typically include hydrocarbyl-substituted succinic acids, anhydrides, esters (including half esters) and halides. Succinimide dispersants are more fully described in U.S. Pat. Nos. 4,234,435 and 3,172,892.

Succinic based dispersants have a wide variety of chemical structures including typically structures such as

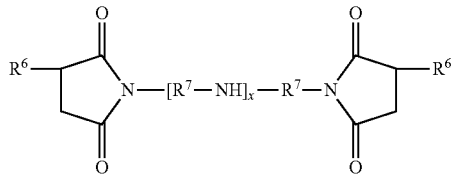

wherein each R6 is independently a hydrocarbyl group, such as a polyolefin-derived group having an $\overline{M}_n$ of 500 or 700 to 10,000. Typically, the hydrocarbyl group is an alkyl group, frequently a polyisobutyl group with a molecular weight of 500 or 700 to 5000, or in another embodiment, 1500 or 2000 to 5000. Alternatively expressed, the R6 groups can contain 40 to 500 carbon atoms and in certain embodiments at least 50, e.g., 50 to 300 carbon atoms, such as aliphatic carbon atoms. Each R6 group may contain one or more reactive groups, e.g., succinic groups. The R7 are alkenyl groups, commonly —C2H4- groups. Such molecules are commonly derived from reaction of an alkenyl acylating agent with a polyamine, and a wide variety of linkages between the two moieties is possible beside the simple imide structure shown above, including a variety of amides and quaternary ammonium salts. Likewise, a variety of modes of attachment of the R6 groups are contemplated, including linkages involving cyclic (non-aromatic ring) structures.

The amines which are reacted with the succinic acylating agents to form the carboxylic dispersant composition can be monoamines or polyamines. Polyamines include principally alkylene polyamines such as ethylene polyamines (i.e., poly(ethyleneamine)s), such as ethylene diamine, triethylene tetramine, propylene diamine, decamethylene diamine, octamethylene diamine, di(heptamethylene) triamine, tripropylene tetramine, tetraethylene pentamine, trimethylene diamine, pentaethylene hexamine, di(-trimethylene) triamine. Higher homologues such as are obtained by condensing two or more of the above-illustrated alkylene amines likewise are useful. Tetraethylene pentamines is particularly useful.

Hydroxyalkyl-substituted alkylene amines, i.e., alkylene amines having one or more hydroxyalkyl substituents on the nitrogen atoms, likewise are useful, as are higher homologues obtained by condensation of the above-illustrated alkylene amines or hydroxy alkyl-substituted alkylene amines through amino radicals or through hydroxy radicals.

In one embodiment, the dispersant may be present as a single dispersant. In one embodiment, the dispersant may be present as a mixture of two or three different dispersants, wherein at least one may be a succinimide dispersant.

The succinimide dispersant may be a derivative of an aromatic amine, an aromatic polyamine, or mixtures thereof. The aromatic amine may be 4-aminodiphenylamine (ADPA) (also known as N-phenylphenylenediamine), derivatives of ADPA (as described in United States Patent Publications 2011/0306528 and 2010/0298185), a nitroaniline, an aminocarbazole, an amino-indazolinone, an aminopyrimidine, 4-(4-nitrophenylazo)aniline, or combinations thereof. In one embodiment, the dispersant is derivative of an aromatic amine wherein the aromatic amine has at least three non-continuous aromatic rings.

The succinimide dispersant may be a derivative of a polyether amine or polyether polyamine. Typical polyether amine compounds contain at least one ether unit and will be chain terminated with at least one amine moiety. The polyether polyamines can be based on polymers derived from $C_2$-$C_6$ epoxides such as ethylene oxide, propylene oxide, and butylene oxide. Examples of polyether polyamines are sold under the Jeffamine® brand and are commercially available from Hunstman Corporation located in Houston, Tex.

Post-treated dispersants may also be a part of the disclosed technology. They are generally obtained by reacting carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds such as boric acid (to give "borated dispersants"), phosphorus compounds such as phosphorus acids or anhydrides, or 2,5-dimercaptothiadiazole (DMTD). Amine dispersants are reaction products of relatively high molecular weight aliphatic or alicyclic halides and amines, such as polyalkylene polyamines. Examples thereof are described in the U.S. Pat. Nos. 3,275,554, 3,438,757, 3,454,555, and 3,565,804. In certain embodiments, one or more of the individual dispersants may be post-treated with boron or DMTD or with both boron and DMTD. Exemplary materials of these kinds are described in the following U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422.

The amount of the dispersant in a completely formulated lubricant, if present, will typically be 0.05 or 0.5 to 10 percent by weight, or 1 to 8 percent by weight, or 3 to 7 percent by weight or 2 to 5 percent by weight. Its concentration in a concentrate will be correspondingly increased, to, e.g., 5 to 80 weight percent.

Detergents

Detergents are generally salts of organic acids, which are often overbased. Metal overbased salts of organic acids are widely known to those of skill in the art and generally include metal salts wherein the amount of metal present exceeds the stoichiometric amount. Such salts are said to have conversion levels in excess of 100% (i.e., they comprise more than 100% of the theoretical amount of metal needed to convert the acid to its "normal" or "neutral" salt). They are commonly referred to as overbased, hyperbased or superbased salts and are usually salts of organic sulfur acids, organic phosphorus acids, carboxylic acids, phenols or mixtures of two or more of any of these. As a skilled worker would realize, mixtures of such overbased salts can also be used.

The overbased compositions can be prepared based on a variety of well-known organic acidic materials including sulfonic acids, carboxylic acids (including substituted salicylic acids), phenols, phosphonic acids, saligenins, salixarates, and mixtures of any two or more of these. These materials and methods for overbasing of them are well known from numerous U.S. patents.

The basically reacting metal compounds used to make these overbased salts are usually an alkali or alkaline earth metal compound, although other basically reacting metal compounds can be used. Compounds of Ca, Ba, Mg, Na and Li, such as their hydroxides and alkoxides of lower alkanols are usually used. Overbased salts containing a mixture of ions of two or more of these metals can be used in the present invention.

Overbased materials are generally prepared by reacting an acidic material (typically an inorganic acid or lower carboxylic acid, such as carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter. The acidic organic compound will, in the present instance, be the above-described saligenin derivative.

The acidic material used in preparing the overbased material can be a liquid such as formic acid, acetic acid, nitric acid, or sulfuric acid. Acetic acid is particularly useful. Inorganic acidic materials can also be used, such as HCl, SO2, SO3, CO2, or H2S, e.g., CO2 or mixtures thereof, e.g., mixtures of CO2 and acetic acid.

Patents specifically describing techniques for making basic salts of acidic organic compounds generally include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Overbased saligenin derivatives are described in PCT publication WO 2004/048503; overbased salixarates are described in PCT publication WO 03/018728.

Overbased sulphonates typically have a TBN of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulphonate detergent may be particularly useful for assisting in improving fuel economy. In one embodiment the sulphonate detergent may be a metal salt of one or more oil-soluble alkyl toluene sulphonate compounds as disclosed in paragraphs [0046] to [0053] of US Patent Application 2008/0119378.

In one embodiment, the sulfonate detergent may be a branched alkylbenzene sulfonate detergent. Branched alkylbenzene sulfonate may be prepared from isomerized alpha olefins, oligomers of low molecular weight olefins, or combinations thereof. Preferred oligomers include tetramers, pentamers, and hexamers of propylene and butylene. In other embodiments, the alkylbenzene sulfonate detergent may be derived from a toluene alkylate, i.e. the alkylbenzene sulfonate has at least two alkyl groups, at least one of which is a methyl group, the other being a linear or branched alkyl group as described above.

In one embodiment, the lubricating composition further comprises a non-sulphur containing phenate, or sulphur containing phenate, or mixtures thereof. The non-sulphur containing phenates and sulphur containing phenates are known in the art. The non-sulphur containing phenate, or sulphur containing phenate may be neutral or overbased. Typically, an overbased non-sulphur containing phenate, or a sulphur containing phenate have a total base number of 180 to 450 TBN and a metal ratio of 2 to 15, or 3 to 10. A neutral non-sulphur containing phenate, or sulphur containing phenate may have a TBN of 80 to less than 180 and a metal ratio of 1 to less than 2, or 0.05 to less than 2.

The non-sulphur containing phenate, or sulphur containing phenate may be in the form of a calcium or magnesium non-sulphur containing phenate, or sulphur containing phenate (typically calcium non-sulphur containing phenate, or sulphur containing phenate). When present the non-sulphur containing phenate, or sulphur containing phenate may be present at 0.1 to 10 wt %, or 0.5 to 8 wt %, or 1 to 6 wt %, or 2.5 to 5.5 wt % of the lubricating composition.

In one embodiment, the lubricating composition may be free of an overbased phenate, and in a different embodiment the lubricating composition may be free of a non-overbased phenate. In another embodiment the lubricating composition may be free of a phenate detergent.

Phenate detergents are typically derived from p-hydrocarbyl phenols. Alkylphenols of this type may be coupled with sulfur and overbased, coupled with aldehyde and overbased, or carboxylated to form salicylate detergents. Suitable alkylphenols include those alkylated with oligomers of propylene, i.e. tetrapropenylphenol (i.e. p-dodecylphenol or PDDP) and pentapropenylphenol. Other suitable alkylphenols include those alkylated with alpha-olefins, isomerized alpha-olefins, and polyolefins like polyisobutylene. In one embodiment, the lubricating composition comprises less than 0.2 wt %, or less than 0.1 wt %, or even less than 0.05 wt % of a phenate detergent derived from PDDP. In one embodiment, the lubricant composition comprises a phenate detergent that is not derived from PDDP. In one embodiment, the lubricating composition comprises a phenate detergent prepared from PDDP wherein the phenate detergent contains less than 1.0 weight percent unreacted PDDP, or less than 0.5 weight percent unreacted PDDP, or substantially free of PDDP.

In one embodiment, the lubricating composition further comprises a salicylate detergent that may be neutral or overbased. The salicylates are known in the art. The salicylate detergent may have a TBN of 50 to 400, or 150 to 350, and a metal ratio of 0.5 to 10, or 0.6 to 2. Suitable salicylate detergents included alkylated salicylic acid, or alkylsalicylic acid. Alkylsalicylic acid may be prepared by alkylation of salicylic acid or by carbonylation of alkylphenol. When alkylsalicylic acid is prepared from alkylphenol, the alkylphenol is selected in a similar manner as the phenates described above. In one embodiment, alkylsalicylate of the invention include those alkylated with oligomers of propylene, i.e., tetrapropenylphenol (i.e., p-dodecylphenol or PDDP) and pentapropenylphenol. Other suitable alkylphenols include those alkylated with alpha-olefins, isomerized alpha-olefins, and polyolefins like polyisobutylene. In one embodiment, the lubricating composition comprises a salicylate detergent prepared from PDDP wherein the phenate detergent contains less than 1.0 weight percent unreacted PDDP, or less than 0.5 weight percent unreacted PDDP, or substantially free of PDDP.

When present, the salicylate may be present at 0.01 to 10 wt %, or 0.1 to 6 wt %, or 0.2 to 5 wt %, 0.5 to 4 wt %, or 1 to 3 wt % of the lubricating composition.

The detergents generally can also be borated by treatment with a borating agent such as boric acid. Typical conditions include heating the detergent with boric acid at 100 to 150° C., the number of equivalents of boric acid being roughly equal to the number of equivalents of metal in the salt. U.S. Pat. No. 3,929,650 discloses borated complexes and their preparation.

The amount of the detergent component in a completely formulated lubricant, if present, will typically be 0.01 to 15 percent by weight, 0.5 to 10 percent by weight, such as 1 to 7 percent by weight, or 1.2 to 4 percent by weight. Its concentration in a concentrate will be correspondingly increased, to, e.g., 5 to 65 weight percent.

Friction Modifiers

Another component that may be used in the composition used in the present technology is a friction modifier. Friction modifiers are well known to those skilled in the art. A list of friction modifiers that may be used is included in U.S. Pat. Nos. 4,792,410, 5,395,539, 5,484,543 and 6,660,695. U.S. Pat. No. 5,110,488 discloses metal salts of fatty acids and especially zinc salts, useful as friction modifiers. A list of friction modifiers that may be used may include: fatty phosphites; borated alkoxylated fatty amines; fatty acid amides; metal salts of fatty acids; fatty epoxides; sulfurized olefins; borated fatty epoxides; fatty imidazolines; fatty amines; condensation products of carboxylic acids and polyalkylene-polyamines; glycerol esters; metal salts of alkyl salicylates; borated glycerol esters; amine salts of alkylphosphoric acids; alkoxylated fatty amines; ethoxylated alcohols; oxazolines; imidazolines; hydroxyalkyl amides; polyhydroxy tertiary amines; and mixtures of two or more thereof.

Representatives of each of these types of friction modifiers are known and are commercially available. For instance, fatty phosphites may be generally of the formula (RO)2PHO or (RO)(HO)PHO where R may be an alkyl or alkenyl group of sufficient length to impart oil solubility. Suitable phosphites are available commercially and may be synthesized as described in U.S. Pat. No. 4,752,416.

Borated fatty epoxides that may be used are disclosed in Canadian Patent No. 1,188,704. These oil-soluble boron-containing compositions may be prepared by reacting a boron source such as boric acid or boron trioxide with a fatty epoxide which may contain at least 8 carbon atoms. Non-borated fatty epoxides may also be useful as friction modifiers.

Borated amines that may be used are disclosed in U.S. Pat. No. 4,622,158. Borated amine friction modifiers (including borated alkoxylated fatty amines) may be prepared by the reaction of a boron compounds, as described above, with the corresponding amines, including simple fatty amines and hydroxy containing tertiary amines. The amines useful for preparing the borated amines may include commercial alkoxylated fatty amines known by the trademark "ETHOMEEN" and available from Akzo Nobel, such as bis[2-hydroxyethyl]-cocoamine, polyoxyethylene-[10]cocoamine, bis[2-hydroxyethyl]soyamine, bis[2-hydroxyethyl]-tallowamine, polyoxyethylene-[5]tallowamine, bis[2-hydroxyethyl]oleylamine, bis[2 hydroxyethyl] octadecylamine, and polyoxyethylene[15]octadecylamine. Such amines are described in U.S. Pat. No. 4,741,848.

Alkoxylated fatty amines and fatty amines themselves (such as oleylamine) may be useful as friction modifiers. These amines are commercially available.

Both borated and unborated fatty acid esters of glycerol may be used as friction modifiers. Borated fatty acid esters of glycerol may be prepared by borating a fatty acid ester of glycerol with a boron source such as boric acid. Fatty acid esters of glycerol themselves may be prepared by a variety of methods well known in the art. Many of these esters, such as glycerol monooleate and glycerol tallowate, are manufactured on a commercial scale. Commercial glycerol monooleates may contain a mixture of 45% to 55% by weight monoester and 55% to 45% by weight diester.

Fatty acids may be used in preparing the above glycerol esters; they may also be used in preparing their metal salts, amides, and imidazolines, any of which may also be used as friction modifiers. The fatty acids may contain 6 to 24 carbon atoms, or 8 to 18 carbon atoms. A useful acid may be oleic acid.

The amides of fatty acids may be those prepared by condensation with ammonia or with primary or secondary amines such as diethylamine and diethanolamine. Fatty imidazolines may include the cyclic condensation product of an acid with a diamine or polyamine such as a polyethylenepolyamine. In one embodiment, the friction modifier may be the condensation product of a C8 to C24 fatty acid with a polyalkylene polyamine, for example, the product of isostearic acid with tetraethylenepentamine. The condensation products of carboxylic acids and polyalkyleneamines may be imidazolines or amides.

The fatty acid may also be present as its metal salt, e.g., a zinc salt. These zinc salts may be acidic, neutral, or basic (overbased). These salts may be prepared from the reaction of a zinc containing reagent with a carboxylic acid or salt thereof. A useful method of preparation of these salts is to react zinc oxide with a carboxylic acid. Useful carboxylic acids are those described hereinabove. Suitable carboxylic acids include those of the formula RCOOH where R is an aliphatic or alicyclic hydrocarbon radical. Among these are those wherein R is a fatty group, e.g., stearyl, oleyl, linoleyl, or palmityl. Also suitable are the zinc salts wherein zinc is present in a stoichiometric excess over the amount needed to prepare a neutral salt. Salts wherein the zinc is present from 1.1 to 1.8 times the stoichiometric amount, e.g., 1.3 to 1.6 times the stoichiometric amount of zinc, may be used. These zinc carboxylates are known in the art and are described in U.S. Pat. No. 3,367,869. Metal salts may also include calcium salts. Examples may include overbased calcium salts.

Sulfurized olefins are also well known commercial materials used as friction modifiers. A suitable sulfurized olefin is one which is prepared in accordance with the detailed teachings of U.S. Pat. Nos. 4,957,651 and 4,959,168. Described therein is a cosulfurized mixture of 2 or more reactants selected from the group consisting of at least one fatty acid ester of a polyhydric alcohol, at least one fatty acid, at least one olefin, and at least one fatty acid ester of a monohydric alcohol. The olefin component may be an aliphatic olefin, which usually will contain 4 to 40 carbon atoms. Mixtures of these olefins are commercially available. The sulfurizing agents useful in the process of the present invention include elemental sulfur, hydrogen sulfide, sulfur halide plus sodium sulfide, and a mixture of hydrogen sulfide and sulfur or sulfur dioxide.

Metal salts of alkyl salicylates include calcium and other salts of long chain (e.g. C12 to C16) alkyl-substituted salicylic acids.

Amine salts of alkylphosphoric acids include salts of oleyl and other long chain esters of phosphoric acid, with amines such as tertiary-aliphatic primary amines, sold under the tradename Primene™.

Eighty-five percent phosphoric acid is a suitable material for addition to the fully-formulated compositions to increase frictional properties and can be included at a level of 0.01-0.3 weight percent based on the weight of the composition, such as 0.03 to 0.2 or to 0.1 percent.

The amount of friction modifier, if it is present, may be 0.01 to 10 or 5 percent by weight of the lubricating composition, 0.1 to 2.5 percent by weight of the lubricating composition, such as 0.1 to 2.0, 0.2 to 1.75, 0.3 to 1.5 or 0.4 to 1 percent. In some embodiments, however, the amount of friction modifier is present at less than 0.2 percent or less than 0.1 percent by weight, for example, 0.01 to 0.1 percent.

Viscosity Modifiers

Other additives may be present in the lubricants of the disclosed technology. One component frequently used is a viscosity modifier. Viscosity modifiers (VM) and dispersant viscosity modifiers (DVM) are well known. Examples of VMs and DVMs may include polymethacrylates, polyacrylates, polyolefins, styrene-maleic ester copolymers, and similar polymeric substances including homopolymers, copolymers, and graft copolymers. The DVM may comprise a nitrogen-containing methacrylate polymer, for example, a nitrogen-containing methacrylate polymer derived from methyl methacrylate and dimethylaminopropylamine.

Examples of commercially available VMs, DVMs and their chemical types may include the following: polyisobutylenes (such as Indopol™ from BP Amoco or Parapol™ from ExxonMobil); olefin copolymers (such as Lubrizol™ 7060, 7065, and 7067 from Lubrizol and Lucant™ HC-2000L and HC-600 from Mitsui); hydrogenated styrene-diene copolymers (such as Shellvis™ 40 and 50, from Shell and LZ® 7308, and 7318 from Lubrizol); styrene/maleate copolymers, which are dispersant copolymers (such as LZ® 3702 and 3715 from Lubrizol); polymethacrylates, some of which have dispersant properties (such as those in the Viscoplex™ series from RohMax, the Hitec™ series from Afton, and LZ 7702™, LZ 7727™, LZ 7725™ and LZ 7720C™ from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell). Also included are Asteric™ polymers from Lubrizol (methacrylate polymers with radial or star architecture). Viscosity modifiers that may be used are described in U.S. Pat. Nos. 5,157,088, 5,256,752 and 5,395,539. The VMs and/or DVMs may be used in the functional fluid at a concentration of up to 20% or 60% or 70% by weight. Concentrations of 0.1 to 12%, 0.1 to 4%, 0.2 to 3%, 1 to 12% or 3 to 10% by weight may be used.

Antioxidants

Other materials can optionally be included in the compositions of the present technology, provided that they are not incompatible with the afore-mentioned required components or specifications. Such materials include antioxidants (that is, oxidation inhibitors), including hindered phenolic antioxidants, secondary aromatic amine antioxidants such as dinonyldiphenylamine as well as such well-known variants as monononyldiphenylamine and diphenylamines with other alkyl substituents such as mono- or di-ocyl, sulfurized phenolic antioxidants, oil-soluble copper compounds, phosphorus-containing antioxidants, and organic sulfides, disulfides, and polysulfides such as 2-hydroxyalkyl, alkyl thioethers or 1-t-dodecylthio-2-propanol or sulfurized 4-carbobutoxycyclohexene or other sulfurized olefins.

The amount of anti-oxidant, if it is present, may be 0.01 to 5 or 3 percent by weight of the lubricating composition, or 0.3 to 1.2 percent by weight of the lubricating composition, such as 0.5 to 1.2, 0.6 to 1.0 or 0.7 to 0.9 or 0.15 to 4.5, or 0.2 to 4, percent by weight.

Other Additives

The compositions of the present invention may also include, or exclude, conventional amounts of other components which are commonly found in lubricating compositions.

Also included may be corrosion inhibitors or metal deactivators such as tolyl triazole and dimercaptothiadiazole and oil-soluble derivatives of such materials. These include derivatives of benzotriazole (typically tolyltriazole), 1,2,4-triazole, benzimidazole, 2-alkyldithiobenzimidazole or 2-alkyldithiobenzothiazole, 1-amino-2-propanol, a derivative of dimercaptothiadiazole, octylamine octanoate, condensation products of dodecenyl succinic acid or anhydride and/or a fatty acid such as oleic acid with a polyamine.

Other optional components include seal swell additives, such as isodecyl sulfolane or phthalate esters, which are designed to keep seals pliable.

Other materials are anti-wear agents such as tridecyl adipate, and various long-chain derivatives of hydroxy carboxylic acids, such as tartrates, tartramides, tartrimides, and citrates as described in US Application 2006-0183647. These optional materials are known to those skilled in the art and are generally commercially available. Yet other commercially available anti-wear gents include dimercaptothiadizoles and their derivatives, which are described in greater detail in published European Patent Application 761,805.

Also included can be known materials such as, demulsifiers dyes, fluidizing agents, odor masking agents. Demulsifiers include trialkyl phosphates, and various polymers and copolymers of ethylene glycol, ethylene oxide, propylene oxide, or mixtures thereof different from the non-hydroxy terminated acylated polyether of the disclosed technology.

Also included may be extreme pressure agents, chlorinated aliphatic hydrocarbons; boron-containing compounds including organic borate esters and organic borate salts; and molybdenum compounds. Extreme Pressure (EP) agents include sulphur- and chlorosulphur-containing EP agents, chlorinated hydrocarbon EP agents and phosphorus EP agents. Examples of such EP agents include chlorinated wax; sulphurised olefins (such as sulphurised isobutylene), organic sulphides and polysulphides such as dibenzyldisulphide, bis-(chlorobenzyl) disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with P2O5; and mixtures thereof (as described in U.S. Pat. No. 3,197,405). The polysulphides are generally characterized as having sulphur-sulphur linkages. Typically, the linkages have about 2 to about 8 sulphur atoms, or about 2 to about 6 sulphur atoms, or 2 to about 4 sulphur atoms. In one embodiment, the polysulphide contains at least about 20 wt %, or at least about 30 wt % of the polysulphide molecules contain three or more sulphur atoms. In one embodiment at least about 50 wt % of the polysulphide molecules are a mixture of tri- or tetra-sulphides. In other embodiments at least about 55 wt %, or at least about 60 wt % of the polysulphide molecules are a mixture of tri- or tetra-sulphides. In one embodiment up to about 90 wt % of the polysulphide molecules are a mixture of tri- or tetra-sulphides. In other embodiments up to about 80 wt % of the polysulphide molecules are a mixture of tri- or tetra-sulphides. The polysulphide in other embodiments contain about 0 wt % to about 20 wt %, or about 0.1 to about 10 wt % of a penta- or higher polysulphide. In one embodiment, the polysulphide contains less than about 30 wt % or less than about 40 wt % of a disulphide in the polysulphide. The polysulphide typically provides about 0.5 to about 5 wt %, or about 1 to about 3 wt %, of sulphur to the lubricating composition.

Pour point depressants are a particularly useful type of additive, often included in the lubricating oils described herein, usually comprising substances such as polymethacrylates, styrene-based polymers, crosslinked alkyl phenols, or alkyl naphthalenes. See for example, page 8 of "Lubricant Additives" by C. V. Smalheer and R. Kennedy Smith (Lesius-Hiles Company Publishers, Cleveland, Ohio, 1967). Pour point depressants that may be useful in the compositions of the disclosed technology also include polyalphaolefins, esters of maleic anhydride-styrene copolymers, polyacrylates or polyacrylamides.

Additional antioxidants can also be included, typically of the aromatic amine or hindered phenol type. These and other additives which may be used in combination with the present invention are described in greater detail in U.S. Pat. No. 4,582,618 (column 14, line 52 through column 17, line 16, inclusive).

Industrial Applications

The compositions of the present invention may also include, or exclude, conventional amounts of other components which are commonly found in lubricating compositions.

The compound of formula (I) may be suitable for use in lubricating compositions such as an engine lubricant for an internal combustion engine, a lubricating composition for a driveline device such as a gear oil, axle gear oil, drive shaft oil, traction oil, manual transmission oil, automatic transmission oil, off-highway oil (such as tractor oil) or automotive gear oil (AGO).

Other components may be present in amounts which are suitable to the end use to which the lubricant is to be employed. Lubricants for driveline devices such as automatic transmissions will typically have their own spectrum of additives; similarly lubricants for engine oils (passenger car, or heavy duty diesel, or marine diesel, or small two-cycle) will each have their characteristic additives, as will lubricants for industrial application such as for use in hydraulic systems, industrial gears, gas compressors or refrigeration systems, which additives are well known to those skilled in the art of lubricating such devices.

Lubricating Composition for an Engine

In one embodiment, the compound of the invention is used as an antifoam component in a lubricating composition for an internal combustion engine, i.e., a crankcase lubricant.

The internal combustion engine may comprise a steel surface, for example, on a cylinder bore, a cylinder block or a piston ring. The internal combustion engine may be a motorcycle, a passenger car, a heavy duty diesel internal combustion engine or a 2-stroke or 4-stroke marine diesel engine.

The lubricating composition can have at least one of: (i) a sulphur content of up to and including 0.5 wt %, less than 0.5 wt % or from 0.1 to 0.4 wt %; (ii) a phosphorus content of up to and including 0.15 wt %, less than 1.5 wt % or from 0.01 or 0.03 to 0.08, 0.10 or 0.12 wt %; and (iii) a sulphated ash content of 0.5 wt % to 1.1 or 1.5 wt % of the lubricating composition.

The lubricating composition comprises an oil of lubricating viscosity, for example, as described above. In one embodiment, the oil of lubricating viscosity is a Group II, Group III, Group IV or Gas-to-Liquid (Fischer-Tropsch) base oil, or mixture thereof.

A typical crankcase lubricant may contain an oil of lubricating viscosity, for example a Group I, Group II, Group III mineral oil or combinations thereof, with a kinematic viscosity of 3.6 to 7.5 mm2/s, or 3.8 to 5.6 mm2/s, or 4.0 to 4.8 mm2/s.

In addition to the compound of formula (I), the engine lubricating composition may further include other additives, for example, selected from those described above, in the amounts indicated above. In one embodiment the disclosed technology provides a lubricating composition further comprising at least one of an overbased detergent (including, for example, overbased sulphonates and phenates), an antiwear agent, an antioxidant (including, for example, phenolic and aminic antioxidants), a friction modifier, a corrosion inhibitor, a dispersant (typically a polyisobutylene succinimide dispersant), a dispersant viscosity modifier, a viscosity modifier (typically an olefin copolymer such as an ethylene-propylene copolymer), or mixtures thereof. In one embodiment the disclosed technology provides a lubricating composition comprising a compound of formula (I) and further comprising an overbased detergent, an antiwear agent, an antioxidant, a friction modifier and a corrosion inhibitor.

Suitable overbased detergents are described in the "Detergents" section above. The engine oil lubricating composition of the invention can comprise an overbased detergent chosen from non-sulphur-containing phenates, sulphur-containing phenates, sulphonates, salixarates, salicyclates and mixtures thereof, or borated equivalents and mixture of borated equivalents thereof. The overbased detergent may be present at 0 wt % to 15 wt %, or 0.1 wt % to 10 wt %, or 0.2 wt % to 8 wt %, or 0.2 wt % to 3 wt %. For example, in a heavy duty diesel engine the detergent may be present at 2 wt % to 3 wt % of the lubricating composition. For a passenger car engine, the detergent may be present at 0.2 wt % to 1 wt % of the lubricating composition. In one embodiment, an engine lubricating composition further comprises at least one overbased detergent with a metal ratio of at least 3, or at least 8, or at least 15.

In one embodiment, an engine lubricating composition may be a lubricating composition further comprising at least one antiwear agent. Suitable antiwear agents are described in the "Anti-wear Agents" section above and include titanium compounds, tartaric acid derivatives such as tartrate esters, amides or tartrimides, malic acid derivatives, citric acid derivatives, glycolic acid derivatives, oil soluble amine salts of phosphorus compounds, sulphurised olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulphides. The antiwear agent many be a phosphorus-containing antiwear agent. Typically, the phosphorus-containing antiwear agent may be a zinc dialkyldithiophosphate, a phosphite, a phosphate, a phosphonate, and an ammonium phosphate salt, or mixtures thereof. Zinc dialkyldithiophosphates are known in the art. The antiwear agent may be present at 0 wt % to 6 or 3 wt %, or 0.1 wt % to 1.5 wt %, or 0.5 wt % to 0.9 wt % of the lubricating composition.

The composition can comprise a molybdenum compound. The molybdenum compound may be an antiwear agent or an antioxidant. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

Suitable antioxidants are described above under "Antioxidants". Antioxidants include sulphurised olefins, diarylamines, alkylated diaryl amines, hindered phenols, molybdenum compounds (such as molybdenum dithiocarbamates), hydroxyl thioethers, or mixtures thereof. In one embodiment the lubricant composition includes an antioxidant, or mixtures thereof. The antioxidant may be present at 0 wt % to 10 wt %, or 0.1 wt % to 6 wt %, or 0.5 wt % to 5 wt %, or 0.5 wt % to 3 wt %, or 0.3 wt % to 1.5 wt % of the lubricant composition.

Suitable friction modifiers are described above under "Friction Modifiers". Engine oil lubricants (i.e. crankcase lubricants), often include friction modifying additives that reduce dynamic friction between two surfaces, typically steel surfaces; this is carried out largely to improve fuel economy. Additives of this type are often referred to as "fatty" and include fatty acids, esters, amides, imides, amines, and combinations thereof. Examples of suitable friction reducing additives include glycerol mono-oleate, oleyl amide, ethoxylated tallow amine, oleyl tartrimide, fatty alkyl esters of tartaric acid, oleyl malimide, fatty alkyl esters of malic acid and combinations thereof. Alternatively, molybdenum additives may be used to reduce friction and improve fuel economy. Examples of molybdenum additives include dinuclear molybdenum dithiocarbamate complexes, for example Sakuralube™ 525 available from Adeka corp.; trinuclear molybdenum dithiocarbamate complexes; molybdenum amines, for example Sakuralube™ 710 available from Adeka corp.; mononuclear molybdenum dithiocarbamate complexes; molybdenum ester/amide additves, for example Molyvan® 855 available from Vanderbilt Chemicals, LLC; molybdated dispersants; and combinations thereof.

Useful corrosion inhibitors for an engine lubricating composition are described above and include those described in paragraphs 5 to 8 of WO2006/047486, octylamine octanoate, condensation products of dodecenyl succinic acid or anhydride and a fatty acid such as oleic acid with a polyamine. In one embodiment, the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Suitable dispersants are described above under "Dispersants". In one embodiment, the composition comprises a succinimide dispersant and this can be a borated or non-borated succinimide dispersant.

Suitable viscosity modifiers and dispersant viscosity modifiers are described above under "Viscosity modifiers". In one embodiment, the lubricating composition of the disclosed technology further comprises a dispersant viscosity modifier. The dispersant viscosity modifier may be present at 0 to 10 wt %, or 0 wt % to 5 wt %, or 0 wt % to 4 wt %, or 0.05 wt % to 2 wt %, or 0.2 wt % to 1.2 wt % of the lubricating composition.

The engine lubricating composition may also comprise a foam inhibitor, pour point depressant, demulsifier, metal deactivator or seal swell agent or mixtures thereof. Suitable candidates are described above under "other additives".

In one embodiment, the lubricating composition comprises a compound of the invention in an amount 0.01 to 1.5 weight percent of the composition; at least one ashless dispersant in an amount 0.5 to 6 weight percent; at least one metal containing overbased detergent in an amount 0.5 to 3 weight percent of the composition; at least one zinc-free anti-wear agent which is a phosphorus-containing compound, a sulfur- and phosphorus-free organic anti-wear agent, or mixtures thereof in an amount 0.01 to 2 weight percent of the composition; at least one ashless antioxidant (selected from hindered phenols and/or diarylamines) in an amount 0.2 to 5 weight percent of the composition; a polymeric viscosity index improver in an amount 0.0 to 6 weight percent of the composition and, optionally, one or more additional additives selected from corrosion inhibitors, foam inhibitors, seal swell agents, and pourpoint depressants.

An engine lubricating composition in different embodiments may have a composition as disclosed in the following table:

TABLE 1

| Additive | Embodiments (wt %) A | B | C |
|---|---|---|---|
| Antifoam | 0.05 to 2 | 0.1 to 1.2 | 0.25 to 0.75 |
| Ashless Dispersant | 0.05 to 10 | 0.75 to 6 | 1.5 to 5 |
| Antioxidant | 0.05 to 10 | 0.2 to 3 | 0.5 to 2 |
| Dispersant Viscosity Modifier | 0 or 0.05 to 5 | 0 or 0.05 to 4 | 0.05 to 2 |
| Overbased Detergent | 0 or 0.05 to 15 | 0.1 to 6 | 0.5 to 3 |
| Antiwear Agent | 0 or 0.05 to 6 | 0.05 to 4 | 0.1 to 2 |
| Friction Modifier | 0 or 0.05 to 10 | 0.5 to 8 | 1 to 6 |
| Viscosity Modifier | 0 or 0.05 to 10 | 0 or 0.05 to 8 | 0 or 0.05 to 6 |
| Any Other Performance Additive | 0.05 to 2 | 0.1 to 1.2 | 0.25 to 0.75 |
| Oil of Lubricating Viscosity | Balance to 100% | Balance to 100% | Balance to 100% |

Lubricating Composition for a Driveline Device

In another embodiment, the compound of the invention is used as an antifoam component in a lubricating composition suitable for lubricating a driveline device such as a manual transmission, automatic transmission, axle, gear or drive shaft. The driveline device may be on an off highway vehicle such as a farm tractor. Off highway vehicles operate under harsher conditions than on-highway vehicles.

A lubricating composition for a driveline device may have a sulphur-content of greater than 0.05 wt %, or 0.4 wt % to 5 wt %, or 0.5 wt % to 3 wt %, 0.8 wt % to 2.5 wt %, 1 wt % to 2 wt %, 0.075 wt % to 0.5 wt %, or 0.1 wt % to 0.25 wt % of the lubricating composition.

A lubricating composition for a driveline device may have a phosphorus content of 100 ppm to 5000 ppm, or 200 ppm to 4750 ppm, 300 ppm to 4500 ppm, or 450 ppm to 4000 ppm. The phosphorus content may be 400 to 2000 ppm, or 400 to 1500 ppm, or 500 to 1400 ppm, or 400 to 900 ppm, or 500 to 850 ppm or 525 to 800 ppm.

The lubricating composition comprises an oil of lubricating viscosity, for example, as described above. In one embodiment, the oil of lubricating viscosity is a Group II, Group III, Group IV or Gas-to-Liquid (Fischer-Tropsch) base oil, or mixture thereof.

In addition to the compound of formula (I) as described herein, the driveline lubricating composition may include further additives, for example, selected from those described above, in the amounts indicated above. In one embodiment, the disclosed technology provides a lubricating composition further comprising at least one of an antiwear agent, a viscosity modifier (typically a polymethacrylate having linear, comb or star architecture), an overbased detergent (including, for example, overbased sulphonates, phenates and salicylates), a dispersant, a friction modifier, an antioxidant (including, for example, phenolic and aminic antioxidants), a dispersant viscosity modifier, and mixtures thereof. In one embodiment, the disclosed technology provides a lubricating composition comprising a compound of formula (I), an oil of lubricating viscosity and further comprising an antiwear agent, a viscosity modifier, and at least one of a dispersant and an overbased detergent. In this embodiment, the lubricating composition may further comprise a friction modifier.

Suitable antiwear agents are described above under "Antiwear agents" and include an oil soluble phosphorus amine salt antiwear agent such as an amine salt of a phosphorus acid ester or mixtures thereof. The amine salt of a phosphorus acid ester includes phosphoric acid esters and amine salts thereof; dialkyldithiophosphoric acid esters and amine salts thereof; phosphites; and amine salts of phosphorus-containing carboxylic esters, ethers, and amides; hydroxy substituted di or tri esters of phosphoric or thiophosphoric acid and amine salts thereof; phosphorylated hydroxy substituted di or tri esters of phosphoric or thiophosphoric acid and amine salts thereof; and mixtures thereof. The amine salt of a phosphorus acid ester may be used alone or in combination. In one embodiment, the oil soluble phosphorus amine salt includes partial amine salt-partial metal salt compounds or mixtures thereof. In one embodiment, the phosphorus compound further includes a sulphur atom in the molecule. Examples of the antiwear agent may include a non-ionic phosphorus compound (typically compounds having phosphorus atoms with an oxidation state of +3 or +5). In one embodiment, the amine salt of the phosphorus compound may be ashless, i.e., metal-free (prior to being mixed with other components). The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Suitable viscosity modifiers and dispersant viscosity modifiers are described above under "Viscosity modifiers". Viscosity modifiers are usually polymers, including polyisobutenes, polymethacrylic acid esters, diene polymers, polyalkylstyrenes, esterified styrene-maleic anhydride copolymers, alkenylarene-conjugated diene copolymers, and polyolefins. Multifunctional viscosity improvers, which also have dispersant and/or antioxidancy properties are known and may optionally be used. The amount of viscosity modifier may range from 0.1 to 70 wt %, or 1 to 50 wt %, or 2 to 40 wt %. In an automotive gear oil, for example, the viscosity modifier and/or dispersant viscosity modifier may be present in the lubricating composition in an amount of 5 to 60 wt %, or 5 to 50 wt %, or 5 to 40 wt %, or 5 to 30 wt % or 5 to 20 wt %. Typically, the viscosity modifier may be a polymethacrylate, or mixtures thereof.

A driveline device lubricating composition may contain a detergent such as described above under "Detergents". A driveline device lubricating composition may contain an overbased detergent that may or may not be borated. For example, the lubricating composition may contain a borated overbased calcium or magnesium sulphonate detergent, or mixtures thereof. Suitable overbased detergents are described in the "Detergents" section above. The lubricating composition of the invention can comprise an overbased detergent chosen from non-sulphur-containing phenates, sulphur-containing phenates, sulphonates, salixarates, salicyclates and mixtures thereof, or borated equivalents and mixture of borated equivalents thereof. In an automotive gear oil, for example, the detergent may be present in the lubricating composition in an amount of 0.05 to 1 wt %, or 0.1 to 0.9 wt %. In a manual transmission fluid, for example, the detergent may be present in the lubricating composition in an amount of at least 0.1%, e.g., 0.14 to 4 wt %, or 0.2 to 3.5 wt %, or 0.5 to 3 wt %, or 1 to 2 wt %, or 0.5 to 4 wt %, or 0.6 to 3.5 wt % or, 1 to 3 wt % or at least 1 wt %, e.g., 1.5 to 2.8 wt %. In one embodiment, the composition can comprise one or more detergents containing calcium. In this embodiment, the total amount of calcium provided by the detergent(s) to the lubricant may be 0.03 to 1 wt %, or 0.1 to 0.6 wt %, or 0.2 to 0.5 wt %.

Suitable dispersants are described above under "Dispersants". The dispersant may be a succinimide dispersant. In one embodiment the succinimide dispersant may be an N-substituted long chain alkenyl succinimide. The long chain alkenyl succinimide may include polyisobutylene succinimide, wherein the polyisobutylene from which it is derived has a number average molecular weight in the range 350 to 5000, or 500 to 3000, or 750 to 1150. In one embodiment, the dispersant for a driveline device may be a post treated dispersant. The dispersant may be post treated with dimercaptothiadiazole, optionally in the presence of one or more of a phosphorus compound, a dicarboxylic acid of an aromatic compound, and a borating agent. In an automotive gear oil, or in a manual transmission fluid, for example, the dispersant may be present in the lubricating composition in an amount of at least 0.1 wt %, or at least 0.3 wt %, or at least 0.5 wt % and at most 5 wt % or 4 wt % or 3 wt % or 2 wt %.

Suitable friction modifiers are described above under "Friction Modifiers". Suitable friction modifiers include:

an amide, or thio amide, represented by the formula R3C(X)NR1R2 where X is O or S and R1 and R2 are each independently hydrocarbyl groups of at least 6 (or 8 to 24 or 10 to 18) carbon atoms and R3 is a hydroxyalkyl group of 1 to 6 carbon atoms or a group formed by the condensation of the hydroxyalkyl group, through a hydroxyl group thereof, with an acylating agent;

a tertiary amine being represented by the formula R4R5NR6 wherein R4 and R5 are each independently alkyl groups of at least 6 carbon atoms and R6 is a polyhydroxy-containing alkyl group or a polyhydroxy-containing alkoxyalkyl group;

N-substituted oxalic acid bisamide or amide-ester containing at least two hydrocarbyl groups of about 12 to about 22 (or 12 to 20 or 12 to 18 or 12 to 16 or 12 to 14 or 14 to 20 or 14 to 18 or 14 to 16) carbon atoms carbon atoms;

fatty imidazolines such as the cyclic condensation product of an acid with a diamine or polyamine such as a polyethylenepolyamine and, in one embodiment, the friction modifier may be the condensation product of a C8 to C24 fatty acid with a polyalkylene polyamine, for example, the product of isostearic acid with tetra-ethylenepentamine (the condensation products of carboxylic acids and poly-alkyleneamines may be imidazolines or amides);

friction modifiers consisting of the reaction product of a carboxylic acid or a reactive equivalent thereof with an aminoalcohol, selected from the group consisting of tris-hydroxymethylaminomethane, 2-amino-2-ethyl-1,3-propanediol, 3-amino-1-propanol, 2-amino-1-propanol, 1-amino-2-propanol, 2-amino-2-methyl-1-propanol, 4-amino-1-butanol, 5-amino-1-pentanol, 2-amino-1-pentanol, 2-amino-1,2-propanediol, 2-amino-1,3-propanediol, 2-amino-2-methyl-1,3-propanediol, N-(2-hydroxyethyl)ethylenediamine, N,N-bis(2-hydroxyethyl)ethylenediamine, 1,3-diamino-2-hydroxypropane, N,N'-bis-(2-hydroxyethyl) ethylenediamine, and 1-aminopropyl-3-diisopropanol amine, wherein the friction modifier contains at least two branched chain alkyl groups, each containing at least 6 carbon atoms;

sulfurized olefins, such as sulfurized vegetable oil, lard oil or $C_{16-18}$ olefins;

borate esters from the reaction product of boron trioxide and an epoxide having at least 8 carbon atoms, or 10 to 20 carbon atoms or comprises a straight chain hydrocarbyl group of 14 carbon atoms (see U.S. Pat. No. 4,584,115) and borate esters formed by the reaction of an alcohol and boric acid, wherein the alcohol is typically branched, & of C6 to C10, or C8 to C10 or C8;

ethoxylated amines;

phosphorus containing compounds such as phosphoric acid as friction stabilizer and di-(fatty) alkyl phosphites; and metal salts of fatty acids.

Friction modifiers (other than (a) a borated phospholipid, and (b) an amine salt of a phosphoric acid ester) also include fatty phosphonate esters, reaction products from fatty carboxylic acids reacted with guanidine, aminoguanidine, urea or thiourea, and salts thereof, fatty amines, esters such as borated glycerol esters, fatty phosphites, fatty acid amides, fatty epoxides, borated fatty epoxides, alkoxylated fatty amines, borated alkoxylated fatty amines, metal salts of fatty acids, or fatty imidazolines, condensation products of carboxylic acids and polyalkylene-polyamines. In an automotive or axle gear oil, for example, the friction modifier may be present in the lubricating composition in an amount of 1 to 5 wt %, or 2 to 4 wt %, or 2 to 3.5 wt %.

Suitable antioxidants are described above under "Antioxidants". Antioxidants include sulphurised olefins, diarylamines, alkylated diaryl amines, hindered phenols, molybdenum compounds (such as molybdenum dithiocarbamates), hydroxyl thioethers, or mixtures thereof.

The driveline lubricating composition may also comprise a foam inhibitor, pour point depressant, corrosion inhibitor, demulsifier, metal deactivator or seal swell agent or mixtures thereof. Suitable candidates are described above under "other additives". Corrosion inhibitors useful for a driveline device include 1-amino-2-propanol, amines, triazole derivatives including tolyl triazole, dimercaptothiadiazole derivatives, octylamine octanoate, condensation products of dodecenyl succinic acid or anhydride and/or a fatty acid such as oleic acid with a polyamine.

A driveline device lubricating composition in different embodiments may have a composition as disclosed in the following table:

TABLE 2

| Additive | Embodiments (wt %) A | B | C | D |
|---|---|---|---|---|
| Antifoam (ppm) | 0.003 or 0.05 to 1.5 | 0.003 or 0.05 to 1.5 | 0.003 to 1, or 0.05 to 1.5 | 0.003 to 0.2 to 0.5, or 0.05 to 1.5 |
| Dispersant | 1 to 4 | 0.1 to 10, 2 to 7 | 0 to 5 | 1 to 6 |
| Extreme Pressure Agent | 3 to 6 | 0 to 6 | 0 to 3 | 0 to 6 |
| Overbased Detergent | 0 or 0.01 to 1 | 0.01 to 3, 0.025 to 2 | 0.5 to 6 | 0.01 to 2 |
| Antioxidant | 0 or 0.01 to 5 | 0.01 to 10 or 2 | 0 or 0.01 to 3 | 0 or 0.01 to 2 |
| Antiwear Agent | 0.5 to 5 | 0.01 to 15 | 0.5 to 3 | 0.01 to 3 |
| Friction Modifier | 0 or 0.01 to 5 | 0.01 to 5 | 0.1 to 1.5 | 0 or 0.01 to 5 |
| Viscosity Modifier | 0.1 to 70 | 0.1 to 15 | 1 to 60 | 0.1 to 70 |
| Any Other Performance Additive | 0 or 0.01 to 10 | 0 or 0.01 to 8 or 10 | 0 or 0.01 to 6 | 0 or 0.01 to 10 |
| Oil of Lubricating Viscosity | Balance to 100% | Balance to 100% | Balance to 100% | Balance to 100% |

Footnote:
The viscosity modifier in the table above may also be considered as an alternative to an oil of lubricating viscosity.
Column A may be representative of an automotive or axle gear lubricant.
Column B may be representative of an automatic transmission lubricant.
Column C may be representative of an off-highway lubricant.
Column D may be representative of a manual transmission lubricant.

In one embodiment, the lubricating composition is a driveline lubricant comprising: an antifoam component according to the present invention, dispersant in an amount of 0.1 to 10 wt %, a detergent in an amount of 0.025 to 3 wt % or when the detergent contains calcium, a detergent in an amount to contribute 130 to 600 ppm to the composition, a phosphorus containing compound in an amount of 0.01 to 0.3 wt %, an antiwear agent in an amount of 0.01 to 15 wt %, a viscosity modifier in an amount of 0 to 12 wt %, an antioxidant in an amount of 0 to 10 wt %, a corrosion inhibitor in an amount of 0.001 to 10 wt % and a friction modifier in an amount of 0.01 to 5 wt %.

In one embodiment, the lubricating composition is a driveline lubricant comprising: an antifoam component according to the present invention, a dispersant in an amount of 0.2 to 7 wt %, a detergent in an amount of 0.1 to 1 wt % or when the detergent contains calcium, a detergent in an amount to contribute 160 to 400 ppm to the composition, a phosphorus containing compound in an amount of 0.03 to 0.2 wt %, an antiwear agent in an amount of 0.05 to 10 wt %, a viscosity modifier in an amount of 0.1 to 10 wt %, an antioxidant in an amount of 0.01 to 5 wt %, a corrosion inhibitor in an amount of 0.005 to 5 wt % and a friction modifier in an amount of 0.01 to 4 wt %.

In one embodiment, the lubricating composition is a driveline lubricant comprising: an antifoam component according to the present invention, a dispersant in an amount of 0.3 to 6 wt %, a detergent in an amount of 0.1 to 8 wt % or when the detergent contains calcium, a detergent in an amount to contribute 0 to 250 ppm to the composition, a phosphorus containing compound in an amount of 0.03 to 0.1 wt %, an antiwear agent in an amount of 0.075 to 5 wt %, a viscosity modifier in an amount of 1 to 8 wt %, an antioxidant in an amount of 0.05 to 3 wt %, a corrosion inhibitor in an amount of 0.01 to 3 wt % and a friction modifier in an amount of 0.25 to 3.5 wt %.

In one embodiment, the lubricating composition is a driveline lubricant comprising: an antifoam component according to the present invention, a dispersant in an amount of 1 to 5 wt %, a detergent containing calcium in an amount to contribute 1 to 200 ppm to the composition, an antiwear agent in an amount of 0.1 to 3 wt %, a viscosity modifier in an amount of 3 to 8 wt %, an antioxidant in an amount of 0.1 to 1.2 wt %, a corrosion inhibitor in an amount of 0.02 to 2 wt % and a friction modifier in an amount of 0.1 to 3 wt %.

In one embodiment, the lubricating composition is a driveline lubricant comprising: an antifoam component according to the present invention, a detergent containing calcium in an amount to contribute 10 to 150 ppm to the composition, an antioxidant in an amount of 0.2 to 1 wt % and a friction modifier in an amount of 0.5 to 2.5 wt %.

In one embodiment, the lubricating composition is a driveline lubricant comprising: an antifoam component according to the present invention, a detergent containing calcium in an amount to contribute 20 to 100 ppm to the composition, an antioxidant in an amount of 0.3 to 1 wt % and a friction modifier in an amount of 1 to 2.5 wt %.

In the above-described embodiments of driveline lubricants, the lubricating composition may comprise an oil of lubricating viscosity chosen from a Group II, Group III, Group IV or Gas-to-Liquid (Fischer-Tropsch) base oil, or mixtures thereof.

Lubricating Composition for a Hydraulic, Turbine or Circulating Oil

In one embodiment, a hydraulic, turbine or circulating oil lubricant composition contains 0.001 wt % to 0.012 wt % of the inventive antifoam component in the lubricating composition or 0.004 wt % or even 0.001 wt % to 0.003 wt %.

The lubricant compositions may also contain one or more additional additives. In some embodiments the additional additives may include an antioxidant; an antiwear agent; a corrosion inhibitor, a rust inhibitor, a dispersant, a demulsifier, a metal deactivator, a friction modifier, a detergent, an emulsifier, an extreme pressure agent, a pour point depressant, a viscosity modifier, or any combination thereof.

The lubricant may further comprise an antioxidant, or mixtures thereof. The antioxidant may be present at 0 wt % to 4.0 wt %, or 0.02 wt % to 3.0 wt %, or 0.03 wt % to 1.5 wt % of the lubricant.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine, benzyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines. In one embodiment, the diphenylamine is alkylated with styrene and 2-methyl-2-propene.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of molybdenum dithiocarbamates, which may be used as an antioxidants, include commercial materials sold under the trade names such as Molyvan 822®, Molyvan® A, Molyvan® 855 and from R. T. Vanderbilt Co., Ltd., and Adeka Sakura-Lube™ S-100, S-165, S-600 and 525, or mixtures thereof. An example of a dithiocarbamate which may be used as an antioxidant or antiwear agent is Vanlube® 7723 from R. T. Vanderbilt Co., Ltd.

The antioxidant may include a substituted hydrocarbyl mono-sulfide represented by the formula:

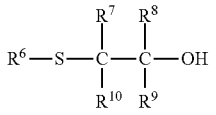

wherein R6 may be a saturated or unsaturated branched or linear alkyl group with 8 to 20 carbon atoms; R7, R8, R9 and R10 are independently hydrogen or alkyl containing 1 to 3 carbon atoms. In some embodiments the substituted hydrocarbyl monosulfides include n-dodecyl-2-hydroxyethyl sulfide, 1-(tert-dodecylthio)-2-propanol, or combinations thereof. In some embodiments, the substituted hydrocarbyl monosulfide is 1-(tert-dodecylthio)-2-propanol.

The lubricant compositions may also include a dispersant or mixtures thereof. Suitable dispersants include: (i) polyetheramines; (ii) borated succinimide dispersants; (iii) non-borated succinimide dispersants; (iv) Mannich reaction products of a dialkylamine, an aldehyde and a hydrocarbyl substituted phenol; or any combination thereof. In some embodiments, the dispersant may be present at 0 wt % to 1.5 wt 5, or 0.01 wt % to 1 wt %, or 0.05 to 0.5 wt % of the overall composition.

Dispersants which may be included in the composition include those with an oil soluble polymeric hydrocarbon backbone and having functional groups that are capable of associating with particles to be dispersed. The polymeric hydrocarbon backbone may have a weight average molecular weight ranging from 750 to 1500 Daltons. Exemplary functional groups include amines, alcohols, amides, and ester polar moieties which are attached to the polymer backbone, often via a bridging group. Example dispersants include Mannich dispersants, described in U.S. Pat. Nos. 3,697,574 and 3,736,357; ashless succinimide dispersants described in U.S. Pat. Nos. 4,234,435 and 4,636,322; amine dispersants described in U.S. Pat. Nos. 3,219,666, 3,565,804, and 5,633,326; Koch dispersants, described in U.S. Pat. Nos. 5,936,041, 5,643,859, and 5,627,259, and polyalkylene succinimide dispersants, described in U.S. Pat. Nos. 5,851,965, 5,853,434, and 5,792,729.

Antifoams, also known as foam inhibitors, are known in the art and include organic silicones and non-silicon foam inhibitors. Examples of organic silicones include dimethyl silicone and polysiloxanes. Examples of non-silicon foam inhibitors include copolymers of ethyl acrylate and 2-ethylhexylacrylate, copolymers of ethyl acrylate, 2-ethylhexylacrylate and vinyl acetate, polyethers, polyacrylates and mixtures thereof. In some embodiments the antifoam is a polyacrylate. Antifoams may be present in the composition from 0.001 wt % to 0.012 wt % or 0.004 wt % or even 0.001 wt % to 0.003 wt %.

Demulsifiers are known in the art and include derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof. Examples of demulsifiers include polyethylene glycols, polyethylene oxides, polypropylene oxides, (ethylene oxide-propylene oxide) polymers and mixtures thereof. In some embodiments the demulsifiers is a polyether. Demulsifiers may be present in the composition from 0.002 wt % to 0.012 wt %.

Pour point depressants are known in the art and include esters of maleic anhydride-styrene copolymers, polymethacrylates; polyacrylates; polyacrylamides; condensation products of haloparaffin waxes and aromatic compounds; vinyl carboxylate polymers; and terpolymers of dialkyl fumarates, vinyl esters of fatty acids, ethylene-vinyl acetate copolymers, alkyl phenol formaldehyde condensation resins, alkyl vinyl ethers and mixtures thereof.

The lubricant compositions may also include a rust inhibitor. Suitable rust inhibitors include hydrocarbyl amine salts of alkylphosphoric acid, hydrocarbyl amine salts of dialkyldithiophosphoric acid, hydrocarbyl amine salts of hydrocarbyl aryl sulphonic acid, fatty carboxylic acids or esters thereof, an ester of a nitrogen-containing carboxylic acid, an ammonium sulfonate, an imidazoline, alkylated succinic acid derivatives reacted with alcohols or ethers, or any combination thereof; or mixtures thereof.

Suitable hydrocarbyl amine salts of alkylphosphoric acid may be represented by the following formula:

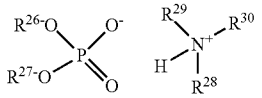

wherein R26 and R27 are independently hydrogen, alkyl chains or hydrocarbyl, typically at least one of R26 and R27 are hydrocarbyl. R26 and R27 contain 4 to 30, or 8 to 25, or 10 to 20, or 13 to 19 carbon atoms. R28, R29 and R30 are independently hydrogen, alkyl branched or linear alkyl chains with 1 to 30, or 4 to 24, or 6 to 20, or 10 to 16 carbon atoms. R28, R29 and R30 are independently hydrogen, alkyl branched or linear alkyl chains, or at least one, or two of R28, R29 and R30 are hydrogen.

Examples of alkyl groups suitable for R28, R29 and R30 include butyl, sec butyl, isobutyl, tert-butyl, pentyl, n-hexyl, sec hexyl, n-octyl, 2-ethyl, hexyl, decyl, undecyl, dodecyl, tridecyl, tetradecyl, pentadecyl, hexadecyl, heptadecyl, octadecyl, octadecenyl, nonadecyl, eicosyl or mixtures thereof.

In one embodiment the hydrocarbyl amine salt of an alkylphosphoric acid is the reaction product of a C14 to C18 alkylated phosphoric acid with Primene 81R (produced and sold by Rohm & Haas) which is a mixture of C11 to C14 tertiary alkyl primary amines.

Hydrocarbyl amine salts of dialkyldithiophosphoric acid may include a rust inhibitor such as a hydrocarbyl amine salt of dialkyldithiophosphoric acid. These may be a reaction product of heptyl or octyl or nonyl dithiophosphoric acids with ethylene diamine, morpholine or Primene 81R or mixtures thereof.

The hydrocarbyl amine salts of hydrocarbyl aryl sulphonic acid may include ethylene diamine salt of dinonyl naphthalene sulphonic acid.

Examples of suitable fatty carboxylic acids or esters thereof include glycerol monooleate and oleic acid. An example of a suitable ester of a nitrogen-containing carboxylic acid includes oleyl sarcosine.

The rust inhibitors may be present in the range from 0.02 wt % to 0.2 wt %, from 0.03 wt % to 0.15 wt %, from 0.04 wt % to 0.12 wt %, or from 0.05 wt % to 0.1 wt % of the lubricating oil composition. The rust inhibitors may be used alone or in mixtures thereof.

The lubricant may contain a metal deactivator, or mixtures thereof. Metal deactivators may be chosen from a derivative of benzotriazole (typically tolyltriazole), 1,2,4-triazole, benzimidazole, 2-alkyldithiobenzimidazole or 2-alkyldithiobenzothiazole, 1-amino-2-propanol, a derivative of dimercaptothiadiazole, octylamine octanoate, condensation products of dodecenyl succinic acid or anhydride and/or a fatty acid such as oleic acid with a polyamine. The metal deactivators may also be described as corrosion inhibitors.

The metal deactivators may be present in the range from 0.001 wt % to 0.1 wt %, from 0.01 wt % to 0.04 wt % or from 0.015 wt % to 0.03 wt % of the lubricating oil composition. Metal deactivators may also be present in the composition from 0.002 wt % or 0.004 wt % to 0.02 wt %. The metal deactivator may be used alone or mixtures thereof.

In one embodiment the invention provides a lubricant composition further comprises a metal-containing detergent. The metal-containing detergent may be a calcium or magnesium detergent. The metal-containing detergent may also be an overbased detergent with total base number ranges from 30 to 500 mg KOH/g Equivalents.

The metal-containing detergent may be chosen from non-sulphur containing phenates, sulphur containing phenates, sulphonates, salixarates, salicylates, and mixtures thereof, or borated equivalents thereof. The metal-containing detergent may be may be chosen from non-sulphur containing phenates, sulphur containing phenates, sulphonates, and mixtures thereof. The detergent may be borated with a borating agent such as boric acid such as a borated overbased calcium or magnesium sulphonate detergent, or mixtures thereof. The detergent may be present at 0 wt % to 5 wt %, or 0.001 wt % to 1.5 wt %, or 0.005 wt % to 1 wt or 0.01 wt % to 0.5 wt % of the hydraulic composition.

The extreme pressure agent may be a compound containing sulphur and/or phosphorus. Examples of an extreme pressure agents include a polysulphide, a sulphurised olefin, a thiadiazole, or mixtures thereof.

Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form oligomers of two or more of said thiadiazole units. Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically, readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilised. In different embodiments the number of carbon atoms on the hydrocarbyl-substituent group includes 1 to 30, 2 to 25, 4 to 20, 6 to 16, or 8 to 10. The 2,5-dimercapto-1,3,4-thiadiazole may be 2,5-dioctyl dithio-1,3,4-thiadiazole, or 2,5-dinonyl dithio-1,3,4-thiadiazole.

The polysulphide includes a sulphurised organic polysulphide from oils, fatty acids or ester, olefins or polyolefins.

Oils which may be sulphurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulphurised fatty acid esters prepared from mixed unsaturated fatty acid esters such as are obtained from animal fats and vegetable oils, including tall oil, linseed oil, soybean oil, rapeseed oil, and fish oil.

The polysulphide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment the sulphurised olefin includes an olefin derived from propylene, isobutylene, pentene or mixtures thereof.

In one embodiment, the polysulphide comprises a polyolefin derived from polymerising by known techniques an olefin as described above.

In one embodiment, the polysulphide includes dibutyl tetrasulphide, sulphurised methyl ester of oleic acid, sulphurised alkylphenol, sulphurised dipentene, sulphurised dicyclopentadiene, sulphurised terpene, and sulphurised Diels-Alder adducts.

The extreme pressure agent may be present at 0 wt % to 3 wt %, 0.005 wt % to 2 wt %, 0.01 wt % to 1.0 wt % of the hydraulics composition.

The lubricant may further comprise a viscosity modifier, or mixtures thereof.

Viscosity modifiers (often referred to as viscosity index improvers) suitable for use in the invention include polymeric materials including a styrene-butadiene rubber, an olefin copolymer, a hydrogenated styrene-isoprene polymer, a hydrogenated radical isoprene polymer, a poly(meth) acrylic acid ester, a polyalkylstyrene, an hydrogenated alkenylaryl conjugated-diene copolymer, an ester of maleic anhydride-styrene copolymer or mixtures thereof. In some embodiments the viscosity modifier is a poly(meth)acrylic acid ester, an olefin copolymer or mixtures thereof. The viscosity modifiers may be present at 0 wt % to 10 wt %, 0.5 wt % to 8 wt %, 1 wt % to 6 wt % of the lubricant.

In one embodiment, the lubricant disclosed herein may contain at least one additional friction modifier other than the salt of the present invention. The additional friction modifier may be present at 0 wt % to 3 wt %, or 0.02 wt % to 2 wt %, or 0.05 wt % to 1 wt %, of the hydraulic composition.

As used herein, the term "fatty alkyl" or "fatty" in relation to friction modifiers means a carbon chain having 10 to 22 carbon atoms, typically a straight carbon chain. Alternatively, the fatty alkyl may be a mono branched alkyl group, with branching typically at the β-position. Examples of mono branched alkyl groups include 2-ethylhexyl, 2-propylheptyl or 2-octyldodecyl.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

In one embodiment, the lubricant composition further includes an additional antiwear agent. Typically, the additional antiwear agent may be a phosphorus antiwear agent (other than the salt of the present invention), or mixtures thereof. The additional antiwear agent may be present at 0 wt % to 5 wt %, 0.001 wt % to 2 wt %, 0.1 wt % to 1.0 wt % of the lubricant.

The phosphorus antiwear agent may include a phosphorus amine salt, or mixtures thereof. The phosphorus amine salt includes an amine salt of a phosphorus acid ester or mixtures thereof. The amine salt of a phosphorus acid ester includes phosphoric acid esters and amine salts thereof; dialkyldithiophosphoric acid esters and amine salts thereof; phosphites; and amine salts of phosphorus-containing carboxylic esters, ethers, and amides; hydroxy substituted di or tri esters of phosphoric or thiophosphoric acid and amine salts thereof; phosphorylated hydroxy substituted di or tri esters of phosphoric or thiophosphoric acid and amine salts thereof; and mixtures thereof. The amine salt of a phosphorus acid ester may be used alone or in combination.

In one embodiment, the oil soluble phosphorus amine salt includes partial amine salt-partial metal salt compounds or mixtures thereof. In one embodiment, the phosphorus compound further includes a sulphur atom in the molecule.

Examples of the antiwear agent may include a non-ionic phosphorus compound (typically compounds having phosphorus atoms with an oxidation state of +3 or +5). In one embodiment, the amine salt of the phosphorus compound may be ashless, i.e., metal-free (prior to being mixed with other components).

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment, the phosphorus acid amine salt includes an amine with C11 to C14 tertiary alkyl primary groups or mixtures thereof. In one embodiment, the phosphorus acid amine salt includes an amine with C14 to C18 tertiary alkyl primary amines or mixtures thereof. In one embodiment, the phosphorus acid amine salt includes an amine with C18 to C22 tertiary alkyl primary amines or mixtures thereof. Mixtures of amines may also be used. In one embodiment, a useful mixture of amines is "Primene® 81R" and "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

In one embodiment, oil soluble amine salts of phosphorus compounds include a sulphur-free amine salt of a phosphorus-containing compound may be obtained/obtainable by a process comprising: reacting an amine with either (i) a hydroxy-substituted di-ester of phosphoric acid, or (ii) a phosphorylated hydroxy-substituted di- or tri-ester of phosphoric acid. A more detailed description of compounds of this type is disclosed in U.S. Pat. No. 8,361,941.

In one embodiment, the hydrocarbyl amine salt of an alkylphosphoric acid ester is the reaction product of a C14 to C18 alkylated phosphoric acid with Primene 81R™ (produced and sold by Rohm & Haas) which is a mixture of C11 to C14 tertiary alkyl primary amines.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81R™, and mixtures thereof.

In one embodiment, the dithiophosphoric acid may be reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, and styrene oxide. In one embodiment the epoxide may be propylene oxide. The glycols may be aliphatic glycols having from 1 to 12, or from 2 to 6, or 2 to 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines. An example of suitable dithiophosphoric acid is prepared by adding phosphorus pentoxide (about 64 grams) at 58° C. over a period of 45 minutes to 514 grams of hydroxypropyl O,O-di(4-methyl-2-pentyl)phosphorodithioate (prepared by reacting di(4-methyl-2-pentyl)-phosphorodithioic acid with 1.3 moles of propylene oxide at 25° C.). The mixture may be heated at 75° C. for 2.5 hours, mixed with a diatomaceous earth and filtered at 70° C. The filtrate contains 11.8% by weight phosphorus, 15.2% by weight sulphur, and an acid number of 87 (bromophenol blue).

In one embodiment, the antiwear additives may include a zinc dialkyldithiophosphate. In other embodiments, the compositions of the present invention are substantially free of, or even completely free of zinc dialkyldithiophosphate.

In one embodiment, the invention provides for a composition that includes a dithiocarbamate antiwear agent defined in U.S. Pat. No. 4,758,362 column 2, line 35 to column 6, line 11. When present the dithiocarbamate antiwear agent may be present from 0.25 wt %, 0.3 wt %, 0.4 wt % or even 0.5 wt % up to 0.75 wt %, 0.7 wt %, 0.6 wt % or even 0.55 wt % in the overall composition.

The hydraulic lubricant may comprise:

0.002 wt % to 0.040 wt % of the inventive antifoam component, 0.0001 wt % to 0.15 wt % of a corrosion inhibitor chosen from 2,5-bis(tert-dodecyldithio)-1,3,4-thiadiazole, tolyltriazole, or mixtures thereof, an oil of lubricating viscosity, 0.02 wt % to 3 wt % of antioxidant chosen from aminic or phenolic antioxidants, or mixtures thereof, 0.005 wt % to 1.5 wt % of a borated succinimide or a non-borated succinimide, 0.001 wt % to 1.5 wt % of a neutral of slightly overbased calcium naphthalene sulphonate (typically a neutral or slightly overbased calcium dinonyl naphthalene sulphonate), and 0.001 wt % to 3 wt %, or 0.01 wt % to 1 wt % of an antiwear agent chosen from zinc dialkyldithiophosphate, zinc dialkylphosphate, amine salt of a phosphorus acid or ester, or mixtures thereof.

The hydraulic lubricant may also comprise a formulation defined in the following table:

TABLE 3

Hydraulic Lubricant compositions

| | Embodiments (wt %) | | |
|---|---|---|---|
| Additive | A | B | C |
| Inventive Antifoam Component | 0.0001 to 0.10 | 0.001 to 0.05 | 0.002 to 0.04 |
| Antioxidant | 0 to 4.0 | 0.02 to 3.0 | 0.03 to 1.5 |
| Dispersant | 0 to 2.0 | 0.005 to 1.5 | 0.01 to 1.0 |
| Detergent | 0 to 5.0 | 0.001 to 1.5 | 0.005 to 1.0 |
| Antiwear Agent | 0 to 5.0 | 0.001 to 2 | 0.1 to 1.0 |
| Friction Modifier | 0 to 3.0 | 0.02 to 2 | 0.05 to 1.0 |
| Viscosity Modifier | 0 to 10.0 | 0.5 to 8.0 | 1.0 to 6.0 |
| Any Other Performance Additive (demulsifier/pour point depressant) | 0 to 1.3 | 0.00075 to 0.5 | 0.001 to 0.4 |
| Metal Deactivator | 0 to 0.1 | 0.01 to 0.04 | 0.015 to 0.03 |
| Rust Inhibitor | 0 to 0.2 | 0.03 to 0.15 | 0.04 to 0.12 |
| Extreme Pressure Agent | 0 to 3.0 | 0.005 to 2 | 0.01 to 1.0 |
| Oil of Lubricating Viscosity | Balance to 100% | Balance to 100% | Balance to 100% |

Refrigerant Lubricants

In one embodiment, the lubricant disclosed herein may be a refrigeration lubricant or gas compressor lubricant. The working fluid can include a lubricant comprised of (i) one or more ester base oils, (ii) one or more mineral oil base oils, (iii) one or more polyalphaolefin (PAO) base oils, (iii) one more alkyl benzene base oils, (iv) one or more polyalkylene glycol (PAG) base oils, (iv) one or more alkylated naphthalene base oils, (v) one or more polyvinylether base oils or any combination thereof to form an oil of lubricating viscosity and 0.001 wt % to 15 wt % of a (thio)phosphoric acid salt of an N-hydrocarbyl-substituted gamma- (γ-) or delta- (δ) amino(thio)ester. The lubricant may be a working fluid in a compressor used for refrigeration or gas compression. In one embodiment, the working fluid may be for a low Global Warming Potential (low GWP) refrigerant system. The working fluid can include a lubricant comprised of ester base oils, mineral oil base oils, polyalphaolefin base oils, polyalkylene glycol base oils or polyvinyl ether base oils alone or in combination to form an oil of lubricating viscosity and 0.001 wt % to 0.012 wt % of the inventive antifoam component in the lubricating composition or 0.004 wt % or even 0.001 wt % to 0.003 wt % and a refrigerant or gas to be compressed.

The ester based oil includes an ester of one or more branched or linear carboxylic acids from C4 to C13. The ester is generally formed by the reaction of the described branched carboxylic acid and one or more polyols.

In some embodiments, the branched carboxylic acid contains at least 5 carbon atoms. In some embodiments, the branched carboxylic acid contains from 4 to 9 carbon atoms. In some embodiments, the polyol used in the preparation of the ester includes neopentyl glycol, glycerol, trimethylol propane, pentaerythritol, dipentaerythritol, tripentaerythritol, or any combination thereof. In some embodiments, the polyol used in the preparation of the ester includes neopentyl glycol, pentaerythritol, dipentaerythritol, or any combination thereof. In some embodiments, the polyol used in the preparation of the ester includes neopentyl glycol. In some embodiments, the polyol used in the preparation of the ester includes pentaerythritol. In some embodiments, the polyol used in the preparation of the ester includes dipentaerythritol.

In some embodiments, the ester is derived from (i) an acid that includes 2-methylbutanoic acid, 3-methylbutanoic acid, or a combination thereof; and (ii) a polyol that includes neopentyl glycol, glycerol, trimethylol propane, pentaerythritol, dipentaerythritol, tripentaerythritol, or any combination thereof.

The lubricant may have the ability to provide an acceptable viscosity working fluid that has good miscibility.

By "acceptable viscosity" it is meant the ester based lubricant and/or the working fluid has a viscosity (as measured by ASTM D445 at 40 degrees C.) of more than 4 cSt. In some embodiments, the ester based lubricant and/or the working fluid has a viscosity at 40 C from 5 or 32 up to 320, 220, 120, or even 68 cSt.

As noted by above, by "low GWP", it is meant the working fluid has a GWP value (as calculated per the Intergovernmental Panel on Climate Change's 2001 Third Assessment Report) of not greater than 1000, or a value that is less than 1000, less than 500, less than 150, less than 100, or even less than 75. In some embodiments, this GWP value is with regards to the overall working fluid. In other embodiments, this GWP value is with regards to the refrigerant present in the working fluid, where the resulting working fluid may be referred to as a low GWP working fluid.

By "good miscibility" it is meant that the refrigerant or compressed gas and lubricant are miscible, at least at the operating conditions the described working fluid will see during the operation of a refrigeration or gas compression system. In some embodiments, good miscibility may mean that the working fluid (and/or the combination of refrigerant and lubricant) does not show any signs of poor miscibility other than visual haziness at temperatures as low as 0° C., or even −25° C., or even in some embodiments as low as −50° C., or even −60° C.

In some embodiments, the described working fluid may further include one or more additional lubricant components. These additional lubricant components may include (i) one or more esters of one or more linear carboxylic acids, (ii) one or more polyalphaolefin (PAO) base oils, (iii) one more alkyl benzene base oils, (iv) one or more polyalkylene glycol (PAG) base oils, (iv) one or more alkylated naphthalene base oils, or (v) any combination thereof.

Additional lubricants that may be used in the described working fluids include certain silicone oils and mineral oils.

Commercially available mineral oils include Sonneborn® LP 250 commercially available from Sonneborn, Suniso® 3GS, 1GS, 4GS, and 5GS, each commercially available from Sonneborn, and Calumet R015 and RO30 commercially available from Calumet. Commercially available alkyl benzene lubricants include Zerol® 150 and Zerol® 300 commercially available from Shrieve Chemical. Commercially available esters include neopentyl glycol dipelargonate, which is available as Emery® 2917 and Hatcol® 2370. Other useful esters include phosphate esters, dibasic acid esters, and fluoroesters. Of course, different mixtures of different types of lubricants may be used.

In some embodiments, the described working fluid further includes one or more esters of one or more linear carboxylic acids.

The working fluids may also include one or more refrigerants. Suitable non-low GWP refrigerants useful in such embodiments are not overly limited. Examples include R-22, R-134a, R-125, R-143a, or any combination thereof. In some embodiments, at least one of the refrigerants is a low GWP refrigerant. In some embodiments, all of the refrigerants present in the working fluid are low GWP refrigerants. In some embodiments, the refrigerant includes R-32, R-290, R-1234yf, R-1234zeI, R-744, R-152a, R-600, R-600a or any combination thereof. In some embodiments, the refrigerant includes R-32, R-290, R-1234yf, R-1234zeI or any combination thereof. In some embodiments, the refrigerant includes R-32. In some embodiments, the refrigerant includes R-290. In some embodiments, the refrigerant includes R-1234yf. In some embodiments, the refrigerant includes R-1234zeI. In some embodiments, the refrigerant includes R-744. In some embodiments, the refrigerant includes R-152a. In some embodiments, the refrigerant includes R-600. In some embodiments, the refrigerant includes R-600a.

In some embodiments, the refrigerant includes R-32, R-600a, R-290, DR-5, DR-7, DR-3, DR-2, R-1234yf, R-1234zeI, XP-10, HCFC-123, L-41A, L-41B, N-12A, N-12B, L-40, L-20, N-20, N-40A, N-40B, ARM-30A, ARM-21A, ARM-32A, ARM-41A, ARM-42A, ARM-70A, AC-5, AC-5X, HPR1D, LTR4X, LTR6A, D2Y-60, D4Y, D2Y-65, R-744, R-1270, or any combination thereof. In some embodiments, the refrigerant includes R-32, R-600a, R-290, DR-5, DR-7, DR-3, DR-2, R-1234yf, R-1234zeI, XP-10, HCFC-123, L-41A, L-41B, N-12A, N-12B, L-40, L-20, N-20, N-40A, N-40B, ARM-30A, ARM-21A, ARM-32A, ARM-41A, ARM-42A, ARM-70A, AC-5, AC-5X, HPR1D, LTR4X, LTR6A, D2Y-60, D4Y, D2Y-65, R-1270, or any combination thereof.

It is noted that the described working fluids may in some embodiments also include one or more non-low GWP refrigerant, blended with the low GWP refrigerant, resulting in a low GWP working fluid. Suitable non-low GWP refrigerants useful in such embodiments are not overly limited. Examples include R-22, R-134a, R-125, R-143a, or any combination thereof.

The described working fluids, at least in regards to how they would be found in the evaporator of the refrigeration system in which they are used, may be from 5 to 50 wt % lubricant, and from 95 to 50 wt % refrigerant. In some embodiments, the working fluid is from 10 to 40 wt % lubricant, or even from 10 to 30 or 10 to 20 wt % lubricant.

The described working fluids, at least in regards to how they would be found in the sump of the refrigeration system in which they are used, may be from 1 to 50, or even 5 to 50 wt % refrigerant, and from 99 to 50 or even 95 to 50 wt % lubricant. In some embodiments, the working fluid is from 90 to 60 or even 95 to 60 wt % lubricant, or even from 90 to 70 or even 95 to 70, or 90 to 80 or even 95 to 80 wt % lubricant.

The described working fluids may include other components for the purpose of enhancing or providing certain functionality to the composition, or in some cases to reduce the cost of the composition.

The described working fluids may further include one or more performance additives. Suitable examples of performance additives include antioxidants, metal passivators and/or deactivators, corrosion inhibitors, antifoam agents in addition to the inventive antifoam component, antiwear inhibitors, corrosion inhibitors, pour point depressants, viscosity improvers, tackifiers, metal deactivators, extreme pressure additives, friction modifiers, lubricity additives, foam inhibitors, emulsifiers, demulsifiers, acid catchers, or mixtures thereof.

In some embodiments, the lubricant compositions include an antioxidant. In some embodiments, the lubricant compositions include a metal passivator, wherein the metal passivator may include a corrosion inhibitor and/or a metal deactivator. In some embodiments, the lubricant compositions include a corrosion inhibitor. In still other embodiments, the lubricant compositions include a combination of a metal deactivator and a corrosion inhibitor. In still further embodiments, the lubricant compositions include the combination of an antioxidant, a metal deactivator and a corrosion inhibitor. In any of these embodiments, the lubricant compositions include one or more additional performance additives.

The antioxidants include butylated hydroxytoluene (BHT), butylatedhydroxyanisole (BHA), phenyl-a-naphthylamine (PANA), octylated/butylated diphenylamine, high molecular weight phenolic antioxidants, hindered bis-phenolic antioxidant, di-alpha-tocopherol, di-tertiary butyl phenol. Other useful antioxidants are described in U.S. Pat. No. 6,534,454.

In some embodiments, the antioxidant includes one or more of:

(i) Hexamethylenebis(3,5-di-tert-butyl-4-hydroxyhydrocinnamate), CAS registration number 35074-77-2, available commercially from BASF;

(ii) N-phenylbenzenamine, reaction products with 2,4,4-trimethylpentene, CAS registration number 68411-46-1, available commercially from BASF;

(iii) Phenyl-a- and/or phenyl-b-naphthylamine, for example N-phenyl-ar-(1,1,3,3-tetramethylbutyl)-1-naphthalenamine, available commercially from BASF;

(iv) Tetrakis[methylene(3,5-di-tert-butyl-4-hydroxyhydrocinnamate)]methane, CAS registration number 6683-19-8;

(v) Thiodiethylenebis (3,5-di-tert-butyl-4-hydroxyhydrocinnamate), CAS registration number 41484-35-9, which is also listed as thiodiethylenebis (3,5-di-tert-butyl-4-hydroxy-hydro-cinnamate) in 21 C.F.R. § 178.3570;

(vi) Butylatedhydroxytoluene (BHT);

(vii) Butylatedhydroxyanisole (BHA), (viii) Bis(4-(1,1,3,3-tetramethylbutyl)phenyl)amine, available commercially from BASF; and (ix) Benzenepropanoic acid, 3,5-bis(1,1-dimethylethyl)-4-hydroxy-, thiodi-2,1-ethanediyl ester, available commercially from BASF.

The antioxidants may be present in the composition from 0.01% to 6.0% or from 0.02%, to 1%. The additive may be present in the composition at 1%, 0.5%, or less. These various ranges are typically applied to all of the antioxidants present in the overall composition. However, in some embodiments, these ranges may also be applied to individual antioxidants.

The metal passivators include both metal deactivators and corrosion inhibitors.

Suitable metal deactivators include triazoles or substituted triazoles. For example, tolyltriazole or tolutriazole may be utilized. Suitable examples of metal deactivator include one or more of:

(i) One or more tolu-triazoles, for example N,N-Bis(2-ethylhexyl)-ar-methyl-1H-benzotriazole-1-methanamine, CAS registration number 94270-86-70, sold commercially by BASF under the trade name Irgamet 39;

(ii) One or more fatty acids derived from animal and/or vegetable sources, and/or the hydrogenated forms of such fatty acids, for example Neo-Fat™ which is commercially available from Akzo Novel Chemicals, Ltd.

Suitable corrosion inhibitors include one or more of:

(i) N-Methyl-N-(1-oxo-9-octadecenyl)glycine, CAS registration number 110-25-8;

(ii) Phosphoric acid, mono- and diisooctyl esters, reacted with tert-alkyl and (C12-C14) primary amines, CAS registration number 68187-67-7;

(iii) Dodecanoic Acid;

(iv) Triphenyl phosphorothionate, CAS registration number 597-82-0; and (v) Phosphoric acid, mono- and dihexyl esters, compounds with tetramethylnonylamines and C11-14 alkylamines.

In one embodiment, the metal passivator is comprised of a corrosion additive and a metal deactivator. One useful additive is the N-acyl derivative of sarcosine, such as an N-acyl derivative of sarcosine. One example is N-methyl-N-(1-oxo-9-octadecenyl) glycine. This derivative is available from BASF under the trade name SARKOSYL™ O. Another additive is an imidazoline such as Amine O™ commercially available from BASF.

The metal passivators may be present in the composition from 0.01% to 6.0% or from 0.02%, to 0.1%. The additive may be present in the composition at 0.05% or less. These various ranges are typically applied to all of the metal passivator additives present in the overall composition. However, in some embodiments, these ranges may also be applied to individual corrosion inhibitors and/or metal deactivators. The ranges above may also be applied to the combined total of all corrosion inhibitors, metal deactivators and antioxidants present in the overall composition.

The refrigerant lubricant composition may also include an antifoam agent in addition to the inventive antifoam component. The antifoam agent may include organic silicones and non-silicon foam inhibitors. Examples of organic silicones include dimethyl silicone and polysiloxanes. Examples of non-silicon foam inhibitors include polyethers, polyacrylates and mixtures thereof as well as copolymers of ethyl acrylate, 2-ethylhexylacrylate, and optionally vinyl acetate. In some embodiments, the antifoam agent may be a polyacrylate. Antifoam agents may be present in the composition from 0.001 wt % to 0.012 wt % or 0.004 wt % or even 0.001 wt % to 0.003 wt %.

The compositions described herein may also include one or more additional performance additives. Suitable additives include antiwear inhibitors, rust/corrosion inhibitors and/or metal deactivators (other than those described above), pour point depressants, viscosity improvers, tackifiers, extreme pressure (EP) additives, friction modifiers, foam inhibitors, emulsifiers, and demulsifiers.

To aid in preventing wear on the metal surface, the present invention may utilize additional anti-wear inhibitor/EP additive and friction modifiers. Anti-wear inhibitors, EP additives, and friction modifiers are available off the shelf from a variety of vendors and manufacturers. Some of these additives may perform more than one task. One product that may provide anti-wear, EP, reduced friction and corrosion inhibition is phosphorus amine salt such as Irgalube 349, which is commercially available from BASF. Another anti-wear/EP inhibitor/friction modifier is a phosphorus compound such as is triphenyl phosphothionate (TPPT), which is commercially available from BASF under the trade name Irgalube TPPT. Another anti-wear/EP inhibitor/friction modifier is a phosphorus compound such as is tricresyl phosphate (TCP), which is commercially available from Chemtura under the trade name Kronitex TCP. Another anti-wear/EP inhibitor/friction modifier is a phosphorus compound such as is t-butylphenyl phosphate, which is commercially available from ICL Industrial Products under the trade name Syn-O-Ad 8478. The anti-wear inhibitors, EP, and friction modifiers are typically 0.1% to 4% of the composition and may be used separately or in combination.

In some embodiments, the composition further includes an additive from the group comprising: viscosity modifiers include ethylene vinyl acetate, polybutenes, polyisobutylenes, polymethacrylates, olefin copolymers, esters of styrene maleic anhydride copolymers, hydrogenated styrene-diene copolymers, hydrogenated radial polyisoprene, alkylated polystyrene, fumed silicas, and complex esters; and tackifiers like natural rubber solubilized in oils.

The addition of a viscosity modifier, thickener, and/or tackifier provides adhesiveness and improves the viscosity and viscosity index of the lubricant. Some applications and environmental conditions may require an additional tacky surface film that protects equipment from corrosion and wear. In this embodiment, the viscosity modifier, thickener/tackifier is 1 to 20 wt % of the lubricant. However, the viscosity modifier, thickener/tackifier may be from 0.5 to 30 wt %. An example of a material Functional V-584 a Natural Rubber viscosity modifier/tackifier, which is available from Functional Products, Inc., Macedonia, Ohio. Another example is a complex ester CG 5000 that is also a multi-functional product, viscosity modifier, pour point depressant, and friction modifier from Inolex Chemical Co. Philadelphia, Pa.

Other oils and/or components may be also added to the composition in the range of 0.1 to 75% or even 0.1 to 50% or even 0.1 to 30%. These oils could include white petroleum oils, synthetic esters (as described in U.S. Pat. No. 6,534,454), severely hydro-treated petroleum oil (known in the industry as "Group II or III petroleum oils"), esters of one or more linear carboxylic acids, polyalphaolefin (PAO) base oils, alkyl benzene base oils, polyalkylene glycol (PAG) base oils, alkylated naphthalene base oils, or any combination thereof.

The lubricant can be used in a refrigeration system, where the refrigeration system includes a compressor and a working fluid, where the working fluid includes a lubricant and a refrigerant. Any of the working fluids described above may be used in the described refrigeration system.

The lubricant may also be able to allow for providing a method of operating a refrigeration system. The described method includes the step of: (I) supplying to the refrigeration system a working fluid that includes a lubricant and a refrigerant. Any of the working fluids described above may be used in the described methods of operating any of the described refrigeration systems.

The present methods, systems and compositions are thus adaptable for use in connection with a wide variety of heat transfer systems in general and refrigeration systems in particular, such as air-conditioning (including both stationary and mobile air conditioning systems), refrigeration, heat-pump, or gas compression systems such as industrial or hydrocarbon gas processing systems. Compression systems such as are used in hydrocarbon gas processing or industrial gas processing systems. As used herein, the term "refrigeration system" refers generally to any system or apparatus, or any part or portion of such a system or apparatus, which employs a refrigerant to provide cooling and/or heating. Such refrigeration systems include, for example, air conditioners, electric refrigerators, chillers, or heat pumps.

The refrigeration lubricant may also comprise a formulation defined in the following table:

TABLE 4

Compressor Lubricant compositions

| | Embodiments (wt %) | | |
|---|---|---|---|
| Additive | A | B | C |
| Inventive Antifoam component | 0.0001 to 0.10 | 0.001 to 0.05 | 0.002 to 0.04 |
| Antioxidant | 0 to 6.0 | 0.01 to 3.0 | 0.03 to 2 |
| Antiwear/EP Agent | 0 to 4.0 | 0.0 to 2 | 0.1 to 1.0 |
| Metal Deactivator/Corrosion Inhibitor | 0 to 6 | 0.0 to 0.5 | 0.015 to 0.1 |
| Oil of Lubricating Viscosity | Balance to 100% | Balance to 100% | Balance to 100% |

Industrial Gear

The lubricants of the invention may include an industrial additive package, which may also be referred to as an industrial lubricant additive package. In other words, the lubricants are designed to be industrial lubricants, or additive packages for making the same. The lubricants do not relate to automotive gear lubricants or other lubricant compositions.

The additives which may be present in the industrial additive package include a foam inhibitor, a demulsifier, a pour point depressant, an antioxidant, a dispersant, a metal deactivator (such as a copper deactivator), an antiwear agent, an extreme pressure agent, a viscosity modifier, or some mixture thereof. The additives may each be present in the range from 50 ppm, 75 ppm, 100 ppm or even 150 ppm up to 5 wt %, 4 wt %, 3 wt %, 2 wt % or even 1.5 wt %, or from 75 ppm to 0.5 wt %, from 100 ppm to 0.4 wt %, or from 150 ppm to 0.3 wt %, where the wt % values are with regards to the overall lubricant composition. In other embodiments the overall industrial additive package may be present from 1 to 20, or from 1 to 10 wt % of the overall lubricant composition. However, it is noted that some additives, including viscosity modifying polymers, which may alternatively be considered as part of the base fluid, may be present in higher amounts including up to 30 wt %, 40 wt %, or even 50 wt % when considered separate from the base fluid. The additives may be used alone or as mixtures thereof.

The lubricant may also include a antifoam agent in addition to the inventive antifoam component. The antifoam agent may include organic silicones and non-silicon foam inhibitors. Examples of organic silicones include dimethyl silicone and polysiloxanes. Examples of non-silicon foam inhibitors include polyethers, polyacrylates and mixtures thereof as well as copolymers of ethyl acrylate, 2-ethylhexylacrylate, and optionally vinyl acetate. In some embodiments the antifoam agent may be a polyacrylate. Antifoam agents may be present in the composition from 0.001 wt % to 0.012 wt % or 0.004 wt % or even 0.001 wt % to 0.003 wt %.

The lubricant may also include demulsifier. The demulsifier may include derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof. Examples of a demulsifier include polyethylene glycols, polyethylene oxides, polypropylene oxides, (ethylene oxide-propylene oxide) polymers and mixtures thereof. The demulsifier may be a polyethers. The demulsifier may be present in the composition from 0.002 wt % to 0.2 wt %.

The lubricant may include a pour point depressant. The pour point depressant may include esters of maleic anhydride-styrene copolymers, polymethacrylates; polyacrylates; polyacrylamides; condensation products of haloparaffin waxes and aromatic compounds; vinyl carboxylate polymers; and terpolymers of dialkyl fumarates, vinyl esters of fatty acids, ethylene-vinyl acetate copolymers, alkyl phenol formaldehyde condensation resins, alkyl vinyl ethers and mixtures thereof.

The lubricant may also include a rust inhibitor, other than some of the additives described above.

The lubricant may also include a rust inhibitor. Suitable rust inhibitors include hydrocarbyl amine salts of alkylphosphoric acid, hydrocarbyl amine salts of dialkyldithiophosphoric acid, hydrocarbyl amine salts of hydrocarbyl aryl sulphonic acid, fatty carboxylic acids or esters thereof, an ester of a nitrogen-containing carboxylic acid, an ammonium sulfonate, an imidazoline, or any combination thereof; or mixtures thereof.

Suitable hydrocarbyl amine salts of alkylphosphoric acid may be represented by the following formula:

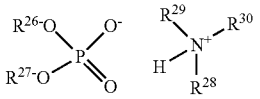

wherein R26 and R27 are independently hydrogen, alkyl chains or hydrocarbyl, typically at least one of R26 and R27 are hydrocarbyl. R26 and R27 contain 4 to 30, or 8 to 25, or 10 to 20, or 13 to 19 carbon atoms. R28, R29 and R30 are independently hydrogen, alkyl branched or linear alkyl chains with 1 to 30, or 4 to 24, or 6 to 20, or 10 to 16 carbon atoms. R28, R29 and R30 are independently hydrogen, alkyl branched or linear alkyl chains, or at least one, or two of R28, R29 and R30 are hydrogen.

Examples of alkyl groups suitable for R28, R29 and R30 include butyl, sec butyl, isobutyl, tert-butyl, pentyl, n-hexyl, sec hexyl, n-octyl, 2-ethyl, hexyl, decyl, undecyl, dodecyl, tridecyl, tetradecyl, pentadecyl, hexadecyl, heptadecyl, octadecyl, octadecenyl, nonadecyl, eicosyl or mixtures thereof.

In one embodiment the hydrocarbyl amine salt of an alkylphosphoric acid may be the reaction product of a C14 to C18 alkylated phosphoric acid with Primene 81R (produced and sold by Rohm & Haas) which may be a mixture of C11 to C14 tertiary alkyl primary amines.

Hydrocarbyl amine salts of dialkyldithiophosphoric acid may include a rust inhibitor such as a hydrocarbyl amine salt of dialkyldithiophosphoric acid. These may be a reaction product of heptyl or octyl or nonyl dithiophosphoric acids with ethylene diamine, morpholine or Primene 81R or mixtures thereof.

The hydrocarbyl amine salts of hydrocarbyl aryl sulphonic acid may include ethylene diamine salt of dinonyl naphthalene sulphonic acid.

Examples of suitable fatty carboxylic acids or esters thereof include glycerol monooleate and oleic acid. An example of a suitable ester of a nitrogen-containing carboxylic acid includes oleyl sarcosine.

The lubricant may contain a metal deactivator, or mixtures thereof. Metal deactivators may be chosen from a derivative of benzotriazole (typically tolyltriazole), 1,2,4-triazole, benzimidazole, 2-alkyldithiobenzimidazole or 2-alkyldithiobenzothiazole, 1-amino-2-propanol, a derivative of dimercaptothiadiazole, octylamine octanoate, condensation products of dodecenyl succinic acid or anhydride and/or a fatty acid such as oleic acid with a polyamine. The metal deactivators may also be described as corrosion inhibitors. The metal deactivators may be present in the range from 0.001 wt % to 0.5 wt %, from 0.01 wt % to 0.04 wt % or from 0.015 wt % to 0.03 wt % of the lubricating oil composition. Metal deactivators may also be present in the composition from 0.002 wt % or 0.004 wt % to 0.02 wt %. The metal deactivator may be used alone or mixtures thereof.

The lubricants may also include antioxidant, or mixtures thereof. The antioxidants, including (i) an alkylated diphenylamine, and (ii) a substituted hydrocarbyl mono-sulfide. In some embodiments the alkylated diphenylamines include bis-nonylated diphenylamine and bis-octylated diphenylamine. In some embodiments the substituted hydrocarbyl monosulfides include n-dodecyl-2-hydroxyethyl sulfide, 1-(tert-dodecylthio)-2-propanol, or combinations thereof. In some embodiments the substituted hydrocarbyl monosulfide may be 1-(tert-dodecylthio)-2-propanol. The antioxidant package may also include sterically hindered phenols. Examples of suitable hydrocarbyl groups for the sterically hindered phenols include 2-ethylhexyl or n-butyl ester, dodecyl or mixtures thereof. Examples of methylene-bridged sterically hindered phenols include 4,4'-methylene-bis(6-tert-butyl o-cresol), 4,4'-methylene-bis(2-tert-amyl-o-cresol), 2,2'-methylene-bis(4-methyl-6-tert-butylphenol), 4,4'-methylene-bis(2,6-di-tertbutylphenol) or mixtures thereof.

The antioxidants may be present in the composition from 0.01 wt % to 6.0 wt % or from 0.02 wt % to 1 wt %. The additive may be present in the composition at 1 wt %, 0.5 wt %, or less.

The lubricant may also include nitrogen-containing dispersants, for example a hydrocarbyl substituted nitrogen containing additive. Suitable hydrocarbyl substituted nitrogen containing additives include ashless dispersants and polymeric dispersants. Ashless dispersants are so-named because, as supplied, they do not contain metal and thus do not normally contribute to sulfated ash when added to a lubricant. However, they may, of course, interact with ambient metals once they are added to a lubricant which includes metal-containing species. Ashless dispersants are characterized by a polar group attached to a relatively high molecular weight hydrocarbon chain. Examples of such materials include succinimide dispersants, Mannich dispersants, and borated derivatives thereof.

The lubricant may also include sulfur-containing compounds. Suitable sulfur-containing compounds include sulfurized olefins and polysulfides. The sulfurized olefin or polysulfides may be derived from isobutylene, butylene, propylene, ethylene, or some combination thereof. In some examples the sulfur-containing compound is a sulfurized olefin derived from any of the natural oils or synthetic oils described above, or even some combination thereof. For example, the sulfurized olefin may be derived from vegetable oil. The sulfurized olefin may be present in the lubricant composition from 0 wt % to 5.0 wt % or from 0.01 wt % to 4.0 wt % or from 0.1 wt % to 3.0 wt %.

The lubricant may also include phosphorus containing compound, such as a fatty phosphite. The phosphorus containing compound may include a hydrocarbyl phosphite, a phosphoric acid ester, an amine salt of a phosphoric acid ester, or any combination thereof. In some embodiments, the phosphorus containing compound includes a hydrocarbyl phosphite, an ester thereof, or a combination thereof. In some embodiments the phosphorus containing compound includes a hydrocarbyl phosphite. In some embodiments, the hydrocarbyl phosphite may be an alkyl phosphite. By alkyl it is meant an alkyl group containing only carbon and hydrogen atoms, however either saturated or unsaturated alkyl groups are contemplated or mixtures thereof. In some embodiments the phosphorus containing compound includes an alkyl phosphite that has a fully saturated alkyl group. In some embodiments, the phosphorus containing compound includes an alkyl phosphite that has an alkyl group with some unsaturation, for example, one double bond between carbon atoms. Such unsaturated alkyl groups may also be referred to as alkenyl groups, but are included within the term "alkyl group" as used herein unless otherwise noted. In some embodiments, the phosphorus containing compound includes an alkyl phosphite, a phosphoric acid ester, an amine salt of a phosphoric acid ester, or any combination thereof. In some embodiments, the phosphorus containing compound includes an alkyl phosphite, an ester thereof, or a combination thereof. In some embodiments the phosphorus containing compound includes an alkyl phosphite. In some embodiments, the phosphorus containing compound includes an alkenyl phosphite, a phosphoric acid ester, an amine salt of a phosphoric acid ester, or any combination thereof. In some embodiments, the phosphorus containing compound includes an alkenyl phosphite, an ester thereof, or a combination thereof. In some embodiments, the phosphorus containing compound includes an alkenyl phosphite. In some embodiments, the phosphorus containing compound includes dialkyl hydrogen phosphites. In some embodiments the phosphorus-containing compound is essentially free of, or even completely free of, phosphoric acid esters and/or amine salts thereof. In some embodiments, the phosphorus-containing compound may be described as a fatty phosphite. Suitable phosphites include those having at least one hydrocarbyl group with 4 or more, or 8 or more, or 12 or more, carbon atoms. Typical ranges for the number of carbon atoms on the hydrocarbyl group include 8 to 30, or 10 to 24, or 12 to 22, or 14 to 20, or 16 to 18. The phosphite may be a mono-hydrocarbyl substituted phosphite, a di-hydrocarbyl substituted phosphite, or a tri-hydrocarbyl substituted phosphite. In one embodiment the phosphite may be sulphur-free i.e., the phosphite is not a thiophosphite. The phosphite having at least one hydrocarbyl group with 4 or more carbon atoms may be represented by the formulae:

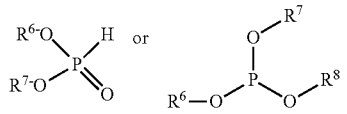

wherein at least one of $R^6$, $R^7$ and $R^8$ may be a hydrocarbyl group containing at least 4 carbon atoms and the other may be hydrogen or a hydrocarbyl group. In one embodiment $R^6$, $R^7$ and $R^8$ are all hydrocarbyl groups. The hydrocarbyl groups may be alkyl, cycloalkyl, aryl, acyclic or mixtures thereof. In the formula with all three groups $R^6$, $R^7$ and $R^8$, the compound may be a tri-hydrocarbyl substituted phosphite i.e., $R^6$, $R^7$ and $R^8$ are all hydrocarbyl groups and in some embodiments may be alkyl groups.

The alkyl groups may be linear or branched, typically linear, and saturated or unsaturated, typically saturated. Examples of alkyl groups for R6, R7 and R8 include octyl, 2-ethylhexyl, nonyl, decyl, undecyl, dodecyl, tridecyl, tetradecyl, pentadecyl, hexadecyl, heptadecyl, octadecyl, octadecenyl, nonadecyl, eicosyl or mixtures thereof. In some embodiments, the fatty phosphite component the lubricant composition overall is essentially free of, or even completely free of phosphoric acid ester and/or amine salts thereof. In some embodiments, the fatty phosphite comprises an alkenyl phosphite or esters thereof, for example esters of dimethyl hydrogen phosphite. The dimethyl hydrogen phosphite may be esterified, and in some embodiments transesterified, by reaction with an alcohol, for example oleyl alcohol.

The lubricant may also include one or more phosphorous amine salts, but in amounts such that the additive package, or in other embodiments the resulting industrial lubricant compositions, contains no more than 1.0 wt % of such materials, or even no more than 0.75 wt % or 0.6 wt %. In other embodiments, the industrial lubricant additive packages, or the resulting industrial lubricant compositions, are essentially free of or even completely free of phosphorous amine salts.

The lubricant may also include one or more antiwear additives and/or extreme pressure agents, one or more rust and/or corrosion inhibitors, one or more foam inhibitors, one or more demulsifiers, or any combination thereof.

In some embodiments, the industrial lubricant additive packages, or the resulting industrial lubricant compositions, are essentially free of or even completely free of phosphorous amine salts, dispersants, or both.

In some embodiments, the industrial lubricant additive packages, or the resulting industrial lubricant compositions, include a demulsifier, a corrosion inhibitor, a friction modifier, or combination of two or more thereof. In some embodiments, the corrosion inhibitor includes a tolyltriazole. In still other embodiments, the industrial additive packages, or the resulting industrial lubricant compositions, include one or more sulfurized olefins or polysulfides; one or more phosphorus amine salts; one or more thiophosphate esters, one or more thiadiazoles, tolyltriazoles, polyethers, and/or alkenyl amines; one or more ester copolymers; one or more carboxylic esters; one or more succinimide dispersants, or any combination thereof.

The industrial lubricant additive package may be present in the overall industrial lubricant from 1 wt % to 5 wt %, or in other embodiments from 1 wt %, 1.5 wt %, or even 2 wt % up to 2 wt %, 3 wt %, 4 wt %, 5 wt %, 7 wt % or even 10 wt %. Amounts of the industrial gear additive package that may be present in the industrial gear concentrate lubricant are the corresponding amounts to the wt % above, where the values are considered without the oil present (i.e., they may be treated as wt % values along with the actual amount of oil present).

The lubricant may also include a derivative of a hydroxy-carboxylic acid. Suitable acids may include from 1 to 5 or 2 carboxy groups or from 1 to 5 or 2 hydroxy groups. In some embodiments, the friction modifier may be derivable from a hydroxy-carboxylic acid represented by the formula:

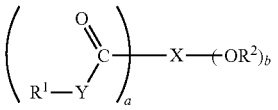

wherein: a and b may be independently integers of 1 to 5, or 1 to 2; X may be an aliphatic or alicyclic group, or an aliphatic or alicyclic group containing an oxygen atom in the carbon chain, or a substituted group of the foregoing types, said group containing up to 6 carbon atoms and having a+b available points of attachment; each Y may be independently —O—, >NH, or >$NR^3$ or two Y's together representing the nitrogen of an imide structure $R^4$—N<formed between two carbonyl groups; and each $R^3$ and $R^4$ may be independently hydrogen or a hydrocarbyl group, provided that at least one $R^1$ and $R^3$ group may be a hydrocarbyl group; each $R^2$ may be independently hydrogen, a hydrocarbyl group or an acyl group, further provided that at least one —$OR^2$ group is located on a carbon atom within X that is α or β to at least one of the —C(O)—Y—$R^1$ groups, and further provided that at least on $R^2$ is hydrogen. The hydroxy-carboxylic acid is reacted with an alcohol and/or an amine, via a condensation reaction, forming the derivative of a hydroxy-carboxylic acid, which may also be referred to herein as a friction modifier additive.

In one embodiment, the hydroxy-carboxylic acid used in the preparation of the derivative of a hydroxy-carboxylic acid is represented by the formula:

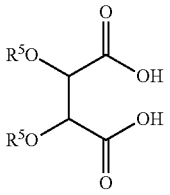

wherein each $R^5$ may independently be H or a hydrocarbyl group, or wherein the $R^5$ groups together form a ring. In one embodiment, where $R^5$ is H, the condensation product is optionally further functionalized by acylation or reaction with a boron compound. In another embodiment the friction modifier is not borated. In any of the embodiments above, the hydroxy-carboxylic acid may be tartaric acid, citric acid, or combinations thereof, and may also be a reactive equivalent of such acids (including esters, acid halides, or anhydrides).

The resulting friction modifiers may include imide, di-ester, di-amide, or ester-amide derivatives of tartaric acid, citric acid, or mixtures thereof. In one embodiment the derivative of hydroxycarboxylic acid includes an imide, a di-ester, a di-amide, an imide amide, an imide ester or an ester-amide derivative of tartaric acid or citric acid. In one embodiment the derivative of hydroxycarboxylic acid includes an imide, a di-ester, a di-amide, an imide amide, an imide ester or an ester-amide derivative of tartaric acid. In one embodiment the derivative of hydroxycarboxylic acid includes an ester derivative of tartaric acid. In one embodiment the derivative of hydroxycarboxylic acid includes an imide and/or amide derivative of tartaric acid. The amines used in the preparation of the friction modifier may have the formula RR'NH wherein R and R' each independently represent H, a hydrocarbon-based radical of 1 or 8 to 30 or 150 carbon atoms, that is, 1 to 150 or 8 to 30 or 1 to 30 or 8 to 150 atoms. Amines having a range of carbon atoms with a lower limit of 2, 3, 4, 6, 10, or 12 carbon atoms and an upper limit of 120, 80, 48, 24, 20, 18, or 16 carbon atoms may also be used. In one embodiment, each of the groups R and R' has 8 or 6 to 30 or 12 carbon atoms. In one embodiment, the sum of carbon atoms in R and R' is at least 8. R and R' may be linear or branched. The alcohols useful for preparing the friction modifier will similarly contain 1 or 8 to 30 or 150 carbon atoms. Alcohols having a range of carbon atoms from a lower limit of 2, 3, 4, 6, 10, or 12 carbon atoms and an upper limit of 120, 80, 48, 24, 20, 18, or 16 carbon atoms may also be used. In certain embodiments the number of carbon atoms in the alcohol-derived group may be 8 to 24, 10 to 18, 12 to 16, or 13 carbon atoms. The alcohols and amines may be linear or branched, and, if branched, the branching may occur at any point in the chain and the branching may be of any length. In some embodiments, the alcohols and/or amines used include branched compounds, and in still other embodiments, the alcohols and amines used are at least 50%, 75% or even 80% branched. In other embodiments, the alcohols are linear. In some embodiments, the alcohol and/or amine have at least 6 carbon atoms. Accordingly, certain embodiments the product prepared from branched alcohols and/or amines of at least 6 carbon atoms, for instance, branched C6-18 or C8-18 alcohols or branched C12-16 alcohols, either as single materials or as mixtures. Specific examples include 2-ethylhexanol and isotridecyl alcohol, the latter of which may represent a commercial grade mixture of various isomers. Also, certain embodiments the product prepared from linear alcohols of at least 6 carbon atoms, for instance, linear C6-18 or C8-18 alcohols or linear C12-16 alcohols, either as single materials or as mixtures. The tartaric acid used for preparing the tartrates, tartrimides, or tartramides may be the commercially available type (obtained from Sargent Welch), and it exists in one or more isomeric forms such as d-tartaric acid, 1-tartaric acid, d,l-tartaric acid or meso-tartaric acid, often depending on the source (natural) or method of synthesis (e.g. from maleic acid). These derivatives may also be prepared from functional equivalents to the diacid readily apparent to those skilled in the art, such as esters, acid chlorides, or anhydrides.

In some embodiments, the additive package includes one or more corrosion inhibitors, one or more dispersants, one or more antiwear and/or extreme pressure additives, one or more extreme pressure agents, one or more antifoam agents in addition to the inventive antifoam component, one or more detergents, and optionally some amount of base oil or similar solvent as a diluent.

The additional additives may be present in the overall industrial gear lubricant composition from 0.1 wt % to 30 wt %, or from a minimum level of 0.1 wt %, 1 wt % or even 2 wt % up to a maximum of 30 wt %, 20 wt %, 10 wt %, 5 wt %, or even 2 wt %, or from 0.1 wt % to 30 wt %, from 0.1 wt % to 20 wt %, from 1 wt % to 20 wt %, from 1 wt % to 10 wt %, from 1 wt % to 5 wt %, or even about 2 wt %. These ranges and limits may be applied to each individual additional additive present in the composition, or to all of the additional additives present.

The Industrial Gear lubricant may comprise:

0.002 wt % to 0.040 wt % of the inventive antifoam component, 0.0001 wt % to 0.15 wt % of a corrosion inhibitor chosen from 2,5-bis(tert-dodecyldithio)-1,3,4-thiadiazole, tolyltriazole, or mixtures thereof, an oil of lubricating viscosity, 0.02 wt % to 3 wt % of antioxidant chosen from aminic or phenolic antioxidants, or mixtures thereof, 0.005 wt % to 1.5 wt % of a borated succinimide or a non-borated succinimide, 0.001 wt % to 1.5 wt % of a neutral or slightly overbased calcium naphthalene sulphonate (typically a neutral or slightly overbased calcium dinonyl naphthalene sulphonate), and 0.001 wt % to 5 wt %, or 0.01 wt % to 3 wt % of an antiwear agent chosen from zinc dialkyldithiophosphate, zinc dialkylphosphate, amine salt of a phosphorus acid or ester, or mixtures thereof The Industrial Gear lubricant may also comprise a formulation defined in the following table:

TABLE 5

| Industrial Gear Lubricant compositions | | | |
|---|---|---|---|
| | Embodiments (wt %) | | |
| Additive | A | B | C |
| Inventive Antifoam component | 0.0001 to 0.10 | 0.001 to 0.05 | 0.002 to 0.04 |
| Sulfurized Olefin | 0 to 5.0 | 0.01 to 4.0 | 0.1 to 3 |
| Dispersant | 0 to 2.0 | 0.005 to 1.5 | 0.01 to 1.0 |
| Demulsifier | 0.002 to 2 | .0025 to 0.5 | 0.005 to 0.04 |
| Metal Deactivator | 0.001 to 0.5 | 0.01 to 0.04 | 0.015 to 0.03 |
| Rust Inhibitor | 0.001 to 1.0 | 0.005 to 0.5 | 0.01 to 0.25 |
| Amine Phosphate | 0 to 3.0 | 0.005 to 2 | 0.01 to 1.0 |
| Antiwear Agent | 0 to 5.0 | 0.001 to 2 | 0.1 to 1.0 |
| Oil of Lubricating Viscosity | Balance to 100% | Balance to 100% | Balance to 100% |

Metal Working Fluid

In one embodiment, the lubricant composition is a metal working fluid. Typical metal working fluid applications may include metal removal, metal forming, metal treating and metal protection. In some embodiments, the metal working oil may be a Group I, Group II or Group III basestock as defined by the American Petroleum Institute. In some embodiments, the metal working oil may be mixed with Group IV or Group V basestock. In one embodiment the lubricant composition may contain the described antifoam component and may contain from 0.0025 wt % to 0.30 wt % or 0.001 wt % to 0.10 wt % or 0.0025 wt % to 0.10 wt % of the antifoam component and further contain one or more additional additives. In some embodiments the functional fluid compositions include an oil. The oil may include most liquid hydrocarbons, for example, paraffinic, olefinic, naphthenic, aromatic, saturated or unsaturated hydrocarbons. In general, the oil is a water-immiscible, emulsifiable hydrocarbon, and in some embodiments the oil is liquid at room temperature. Oils from a variety of sources, including natural and synthetic oils and mixtures thereof may be used.

Natural oils include animal oils and vegetable oils (e.g., soybean oil, lard oil) as well as solvent-refined or acid-refined mineral oils of the paraffinic, naphthenic, or mixed paraffin-naphthenic types. Oils derived from coal or shale are also useful. Synthetic oils include hydrocarbon oils and halo-substituted hydrocarbon oils such as polymerized and interpolymerized olefins e.g., polybutylenes, polypropylenes, propylene-isobutylene copolymers, chlorinated polybutylenes; alkyl benzenes e.g., dodecylbenzenes, tetradecylbenzenes, dinonylbenzenes, or di-(2-ethylhexyl) benzenes.

Another suitable class of synthetic oils that may be used comprises the esters of dicarboxylic acids (e.g., phthalic acid, succinic acid, alkyl succinic acid, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, pentaerythritol, etc.). Specific examples of these esters include dibutyl adipate, di(2-ethylhexyl)-sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, or a complex ester formed by reacting one mole of sebacic acid with two moles of tetraethylene glycol and two moles of 2-ethyl-hexanoic acid.

Esters useful as synthetic oils also include those made from C5 to C12 monocarboxylic acids and polyols and polyol ethers such as neopentyl glycol, trimethylol propane, pentaerythritol, dipentaerythritol, tripentaerythritol, etc.

Unrefined, refined and rerefined oils (and mixtures of each with each other) of the type disclosed hereinabove may be used. Unrefined oils are those obtained directly from a natural or synthetic source without further purification treatment. For example, a shale oil obtained directly from a retorting operation, a petroleum oil obtained directly from distillation or ester oil obtained directly from an esterification process and used without further treatment would be an unrefined oil. Refined oils are similar to the unrefined oils except that they have been further treated in one or more purification steps to improve one or more properties. Many such purification techniques are known to those of skill in the art such as solvent extraction, distillation, acid or base extraction, filtration, percolation, etc. Re-refined oils are obtained by processes similar to those used to obtain refined oils applied to refined oils which have been already used in service. Such re-refined oils are also known as reclaimed or reprocessed oils and often are additionally processed by techniques directed toward removal of spent additives and oil breakdown products.

In some embodiments the oil is a Group II or Group III basestock as defined by the American Petroleum Institute.

Optional additional materials may be incorporated in the compositions disclosed herein. Typical finished compositions may include lubricity agents such as fatty acids and waxes, anti-wear agents, dispersants, corrosion inhibitors, normal and overbased detergents, demulsifiers, biocidal agents, metal deactivators, or mixtures thereof.

The lubricant compositions may comprise the antifoam component described above as an additive, which may be used in combination with one or more additional additives, and which may optionally also include a solvent or diluent, for example one or more of the oils described above. This composition may be referred to as an additive package or a surfactant package.

Example waxes include petroleum, synthetic, and natural waxes, oxidized waxes, microcrystalline waxes, wool grease (lanolin) and other waxy esters, and mixtures thereof. Petroleum waxes are paraffinic compounds isolated from crude oil via some refining process, such as slack wax and paraffin wax. Synthetic waxes are waxes derived from petrochemicals, such as ethylene or propylene. Synthetic waxes include polyethylene, polypropylene, and ethylene-propylene copolymers. Natural waxes are waxes produced by plants and/or animals or insects. These waxes include beeswax, soy wax and carnauba wax. Insect and animal waxes include beeswax, or spermaceti. Petrolatum and oxidized petrolatum may also be used in these compositions. Petrolatums and oxidized petrolatums may be defined, respectively, as purified mixtures of semisolid hydrocarbons derived from petroleum and their oxidation products. Microcrystalline waxes may be defined as higher melting point waxes purified from petrolatums. The wax(es) may be present in the metal working composition at from 0.1 wt % to 75 wt %, e.g., 0.1 wt % to 50 wt %.

Fatty acids useful herein include monocarboxylic acids of 8 to 35 carbon atoms, and in one embodiment 16 to 24 carbon atoms. Examples of such monocarboxylic acids include unsaturated fatty acids, such as myristoleic acid, palmitoleic acid, sapienic acid, oleic acid, elaidic acid, vaccenic acid, linoleic acid, linoelaidic acid; α-linolenic acid; arachidonic acid; eicosapentaenoic acid; erucic acid, docosahexaenoic acid; and saturated fatty acids, such as caprylic acid; capric acid; lauric acid, myristic acid; palmitic acid; stearic acid, arachidic acid, behenic acid; lignoceric acid, cerotic acid, isostearic acid, gadoleic acid, tall oil fatty acids, or combinations thereof. These acids may be saturated, unsaturated, or have other functional groups, such as hydroxy groups, as in 12-hydroxy stearic acid, from the hydrocarbyl backbone. Other example carboxylic acids are described in U.S. Pat. No. 7,435,707. The fatty acid(s) may be present in the metal working composition at from 0.1 wt % to 50 wt %, or 0.1 wt % to 25 wt %, or 0.1 wt % to 10 wt %.

Example overbased detergents include overbased metal sulfonates, overbased metal phenates, overbased metal salicylates, overbased metal saliginates, overbased metal carboxylates, or overbased calcium sulfonate detergents. The overbased detergents contain metals such as Mg, Ba, Sr, Zn, Na, Ca, K, and mixtures thereof. Overbased detergents are metal salts or complexes characterized by a metal content in excess of that which would be present according to the stoichiometry of the metal and the particular acidic organic compound reacted with the metal, e.g., a sulfonic acid.

The term "metal ratio" is used herein to designate the ratio of the total chemical equivalents of the metal in the overbased material (e.g., a metal sulfonate or carboxylate) to the chemical equivalents of the metal in the product which would be expected to result in the reaction between the organic material to be overbased (e.g., sulfonic or carboxylic acid) and the metal-containing reactant used to form the detergent (e.g., calcium hydroxide, barium oxide, etc.) according to the chemical reactivity and stoichiometry of the two reactants. Thus, while in a normal calcium sulfonate, the metal ratio is one, in the overbased sulfonate, the metal ratio is 4.5.

Examples of such detergents are described, for example, in U.S. Pat. Nos. 2,616,904; 2,695,910; 2,767,164; 2,767,209; 2,798,852; 2,959,551; 3,147,232; 3,274,135; 4,729,791; 5,484,542 and 8,022,021. The overbased detergents may be used alone or in combination. The overbased detergents may be present in the range from 0.1 wt % to 20%; such as at least 1 wt % or up to 10 wt % of the composition.

Exemplary surfactants include nonionic polyoxyethylene surfactants such as ethoxylated alkyl phenols and ethoxylated aliphatic alcohols, polyethylene glycol esters of fatty, resin and tall oil acids and polyoxyethylene esters of fatty acids or anionic surfactants such as linear alkyl benzene sulfonates, alkyl sulfonates, alkyl ether phosphonates, ether sulfates, sulfosuccinates, and ether carboxylates. The surfactants(s) may be present in the metal working composition at from 0.0001 wt % to 10 wt %, or 0.0001 wt % to 2.5 wt %.

The lubricant may also include a antifoam agent in addition to the antifoam component described above. The additional antifoam agent may include organic silicones and non-silicon foam inhibitors. Examples of organic silicones include dimethyl silicone and polysiloxanes. Examples of non-silicon foam inhibitors include polyethers, polyacrylates and mixtures thereof as well as copolymers of ethyl acrylate, 2-ethylhexylacrylate, and optionally vinyl acetate. In some embodiments the antifoam agent may be a polyacrylate. Antifoam agents may be present in the composition from 0.0025 wt % to 0.30 wt % or 0.001 wt % or even 0.0025 wt % to 0.10 wt %.

Demulsifiers useful herein include polyethylene glycol, polyethylene oxides, polypropylene alcohol oxides (ethylene oxide-propylene oxide) polymers, polyoxyalkylene alcohol, alkyl amines, amino alcohol, diamines or polyamines reacted sequentially with ethylene oxide or substituted ethylene oxide mixtures, trialkyl phosphates, and combinations thereof. The demulsifier(s) may be present in the corrosion-inhibiting composition at from 0.0001 wt % to 10 wt %, e.g., 0.0001 wt % to 2.5 wt %.

The corrosion inhibitors which may be used include thiazoles, triazoles and thiadiazoles. Examples include benzotriazole, tolyltriazole, octyltriazole, decyltriazole, dodecyltriazole, 2-mercaptobenzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis-(hydrocarbyldithio)-1,3,4-thiadiazoles. Other suitable inhibitors of corrosion include ether amines; polyethoxylated compounds such as ethoxylated amines, ethoxylated phenols, and ethoxylated alcohols; imidazolines. Other suitable corrosion inhibitors include alkenylsuccinic acids in which the alkenyl group contains 10 or more carbon atoms such as, for example, tetrapropenylsuccinic acid, tetradecenylsuccinic acid, hexadecenylsuccinic acid; long-chain alpha, omega-dicarboxylic acids in the molecular weight range of 600 to 3000; and other similar materials. Other non-limiting examples of such inhibitors may be found in U.S. Pat. Nos. 3,873,465, 3,932,303, 4,066,398, 4,402,907, 4,971,724, 5,055,230, 5,275,744, 5,531,934, 5,611,991, 5,616,544, 5,744,069, 5,750,070, 5,779,938, and 5,785,896; Corrosion Inhibitors, C. C. Nathan, ed., NACE, 1973; I. L. Rozenfeld, Corrosion Inhibitors, McGraw-Hill, 1981; Metals Handbook, 9th Ed., Vol. 13—Corrosion, pp. 478497; Corrosion Inhibitors for Corrosion Control, B. G. Clubley, ed., The Royal Society of Chemistry, 1990; Corrosion Inhibitors, European Federation of Corrosion Publications Number 11, The Institute of Materials, 1994; Corrosion, Vol. 2—Corrosion Control, L. L. Sheir, R. A. Jarman, and G. T. Burstein, eds., Butterworth-Heinemann, 1994, pp. 17:10-17:39; Y. I. Kuznetsov, Organic Inhibitors of Corrosion of Metals, Plenum, 1996; and in V. S. Sastri, Corrosion Inhibitors: Principles and Applications, Wiley, 1998. The other corrosion inhibitor(s) may be present in the metal-working composition at from 0.0001 wt % to 5 wt %, e.g., 0.0001 wt % to 3 wt %.

Dispersants which may be included in the composition include those with an oil soluble polymeric hydrocarbon backbone and having functional groups that are capable of associating with particles to be dispersed. The polymeric hydrocarbon backbone may have a weight average molecular weight ranging from 750 to 1500 Daltons. Exemplary functional groups include amines, alcohols, amides, and ester polar moieties which are attached to the polymer backbone, often via a bridging group. Example dispersants include Mannich dispersants, described in U.S. Pat. Nos. 3,697,574 and 3,736,357; ashless succinimide dispersants described in U.S. Pat. Nos. 4,234,435 and 4,636,322; amine dispersants described in U.S. Pat. Nos. 3,219,666, 3,565,804, and 5,633,326; Koch dispersants, described in U.S. Pat. Nos. 5,936,041, 5,643,859, and 5,627,259, and polyalkylene succinimide dispersants, described in U.S. Pat. Nos. 5,851,965, 5,853,434, and 5,792,729. The dispersant(s) may be present in the metal-working composition at from 0.0001 wt % to 10 wt %, e.g., 0.0005 wt % to 2.5 wt %.

In one embodiment the metal working composition disclosed herein may contain a friction modifier. The friction modifier may be present at 0 wt % to 6 wt %, or 0.01 wt % to 4 wt %, or 0.05 wt % to 2 wt %, or 0.1 wt % to 2 wt % of the metal-working composition.

As used herein the term "fatty alkyl" or "fatty" in relation to friction modifiers means a carbon chain having 10 to 22 carbon atoms, typically a straight carbon chain. Alternatively, the fatty alkyl may be a mono branched alkyl group, with branching typically at the β-position. Examples of mono branched alkyl groups include 2-ethylhexyl, 2-propylheptyl or 2-octyldodecyl.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, molybdenum dialkyldithiophosphates, molybdenum dithiocarbamates, or other oil soluble molybdenum complexes such as Molyvan® 855 (commercially available from R.T. Vanderbilt, Inc) or Sakuralube® S-700 or Sakuralube® S-710 (commercially available from Adeka, Inc). The oil soluble molybdenum complexes assist in lowering the friction but may compromise seal compatibility.

In one embodiment the friction modifier may be an oil soluble molybdenum complex. The oil soluble molybdenum complex may include molybdenum dithiocarbamate, molybdenum dithiophosphate, molybdenum blue oxide complex or other oil soluble molybdenum complex or mixtures thereof. The oil soluble molybdenum complex may be a mix of molybdenum oxide and hydroxide, so called "blue" oxide. The molybdenum blue oxides have the molybdenum in a mean oxidation state of between 5 and 6 and are mixtures of MoO2(OH) to MoO2.5(OH)0.5. An example of the oil soluble is molybdenum blue oxide complex known by the tradename of Luvodor® MB or Luvador® MBO (commercially available from Lehmann and Voss GmbH), The oil soluble molybdenum complexes may be present at 0 wt % to 5 wt %, or 0.1 wt % to 5 wt % or 1 to 3 wt % of the metal-working composition.

In one embodiment the friction modifier may be a long chain fatty acid ester. In another embodiment the long chain fatty acid ester may be a mono-ester and in another embodiment the long chain fatty acid ester may be a triglyceride such as sunflower oil or soybean oil or the monoester of a polyol and an aliphatic carboxylic acid.

The extreme pressure agent may be a compound containing sulphur and/or phosphorus and/or chlorine. Examples of an extreme pressure agents include a polysulphide, a sulphurised olefin, a thiadiazole, chlorinated paraffins, overbased sulphonates or mixtures thereof.

Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form oligomers of two or more of said thiadiazole units. Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically, readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilised. In different embodiments the number of carbon atoms on the hydrocarbyl-substituent group includes 1 to 30, 2 to 25, 4 to 20, 6 to 16, or 8 to 10. The 2,5-dimercapto-1,3,4-thiadiazole may be 2,5-dioctyl dithio-1,3,4-thiadiazole, or 2,5-dinonyl dithio-1,3,4-thiadiazole.

In one embodiment at least 50 wt % of the polysulphide molecules are a mixture of tri- or tetra-sulphides. In other embodiments at least 55 wt %, or at least 60 wt % of the polysulphide molecules are a mixture of tri- or tetra-sulphides.

The polysulphide includes a sulphurised organic polysulphide from oils, fatty acids or ester, olefins or polyolefins. Oils which may be sulphurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulphurised fatty acid esters prepared from mixed unsaturated fatty acid esters such as are obtained from animal fats and vegetable oils, including tall oil, linseed oil, soybean oil, rapeseed oil, and fish oil.

The polysulphide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment the sulphurised olefin includes an olefin derived from propylene, isobutylene, pentene or mixtures thereof.

In one embodiment the polysulphide comprises a polyolefin derived from polymerising by known techniques an olefin as described above. In one embodiment the polysulphide includes dibutyl tetrasulphide, sulphurised methyl ester of oleic acid, sulphurised alkylphenol, sulphurised dipentene, sulphurised dicyclopentadiene, sulphurised terpene, and sulphurised Diels-Alder adducts.

Chlorinated paraffins may include both long chain chlorinate paraffins (C20+ and medium chain chlorinated paraffins (C14-C17). Examples include Choroflo, Paroil and Chlorowax products from Dover Chemical.

Overbased sulphonates have been discussed above. Examples of overbased sulfonates include Lubrizol® 5283C, Lubrizol® 5318A, Lubrizol® 5347LC and Lubrizol® 5358.

The metal working fluid may have a composition defined in the following table:

TABLE 6

Metal Working Compositions

| | Embodiments (wt %) | | |
|---|---|---|---|
| Additive | Heavy Duty Oil | Flute Grinding | Hot Mill Oil for Steel Rolling |
| Disclosed Antifoam Component | 0.0025-0.30 | 0.001-0.10 | 0.0025-0.30 |
| Friction Modifier Agent | 0-5 | 0-5 | 0-5 |
| Extreme Pressure Agent | 0-5 | 0-5 | 0-5 |
| Phenolic or Aminic Antioxidant | 0-5 | 0-5 | 0-5 |
| Dispersant | 0-3 | 0-3 | 0-3 |
| Diluent Oil | Balance to 100% | Balance to 100% (blend of 2 oils) | Balance to 100% (blend of Grp II/III and Grp V oil) |

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

Methods of lubricating a mechanical device using a lubricating composition comprising a poly(acrylate) copolymer as described above are also disclosed. The mechanical device may be a driveline device, comprising an axle, a gear, a gearbox or a transmission. The mechanical device may also be an internal combustion engine. In yet other embodiments, the mechanical device may be a hydraulic system, a turbine system, a circulating oil system, a refrigeration lubricant system, or an industrial gear.

Methods of inhibiting or reducing foam in a mechanical device using a lubricating composition comprising a poly(acrylate) copolymer as described above are also disclosed. In some embodiments, the mechanical device may have at least one silicon-containing gasket. The disclosed poly(acrylate) copolymer may also be used to increase the thermal and/or oxidation stability of a lubricating composition.

EXAMPLES

The following examples provide illustrations of the disclosed technology. These examples are non-exhaustive and are not intended to limit the scope of the disclosed technology.

The copolymer antifoam components of the present invention can be prepared by methods generally known in the art. The polymerization may be affected in mass, emulsion or solution in the presence of a free-radical liberating agent as catalyst and in the presence or absence of known polymerization regulators, and/or solvents. The solvent may be aliphatic (such as heptanes) or aromatic (such as xylene or toluene). In another embodiment, the antifoam can be polymerized in a hydrocarbon oil. In yet other embodiments, the antifoam may be polymerized in light aromatic petroleum naphtha, heavy aromatic naphtha, or combinations thereof. In one embodiment, the inventive antifoam can be polymerized in the presence of toluene.

Comparative Composition 1 (EHAT:EAT 85:15 by Wt)—in Toluene Process

Comparative Composition 1 is prepared by thoroughly mixing ethyl acrylate (EAT) (45.0 g), 2-ethylhexyl acrylate (EHAT) (255.0 g), toluene (300.0 g), and tert-butyl peroxy-2-ethylhexanoate (TBPE) (0.33 g) in a glass bottle. Then, 200.0 g of the mixture is transferred to a 1 L round bottom flask equipped with a mechanical stirrer, Claisen adapter with water-cooled condenser and nitrogen inlet (set at 0.5 standard cubic feet per hours (scfh)), a thermocouple, and stopper ("reaction vessel"). This reaction mixture is heated to 110° C. Then the remaining 400 g of the mixture is added dropwise over 90 minutes to the flask via addition funnel and maintained at 110° C. for the duration of the addition. After all the monomer mixture is transferred to the reaction vessel, the reaction temperature is maintained at 110° C. for 60 min. Then TBPE (0.08 g) is added to the reaction vessel in toluene (5.0 g), and held at 110° C. for 60 min. Similarly, one more TBPE (0.08 g) aliquot in toluene (5.0 g) is charged and allowed to react for 60 min. Once complete monomer consumption is observed the reaction contents are cooled to room temperature and transferred to a IL round bottom flask. Then toluene is removed using rotary evaporator to obtain a viscus (poly)acrylate polymer 1 with $M_w$ of 41090 Da. The polymer is blended with oil to be 40% actives.

Preparation of Inventive Composition 2 (EAT:V13F, 60:40 by Wt)—in Toluene Process Inventive Composition 2 is prepared by thoroughly mixing ethyl acrylate (EAT) (103.0 g), 3,3,4,4,5,5,6,6,7,7,8,8,8 tridecafluorooctyl acrylate (V13F) (68.6 g), toluene (171.6 g), and tert-butyl peroxy-2-ethylhexanoate (TBPE) (0.19 g)

in a glass bottle. Then, 114.4 g of the mixture is transferred to a IL round bottom flask equipped with a mechanical stirrer, Claisen adapter with water-cooled condenser and nitrogen inlet (set at 0.2 standard cubic feet per hours (scfh)), a thermocouple and stopper ("reaction vessel"). This reaction mixture is heated to 110° C. Then the remaining 228.8 g of the mixture is added over 90 minutes via peristaltic pump and maintained at 110° C. for the duration of the addition. After all the monomer mixture is transferred to the reaction vessel, the reaction temperature is maintained at 110° C. for 60 min. Then TBPE (0.12 g) is added to the reaction vessel and held at 110° C. for 40 min. Similarly, five more TBPE (0.12 g) aliquots are charged and allowed to react for 40 min after each addition. Once complete monomer consumption is observed the reaction contents are cooled to give a solution containing a fluoro(poly)acrylate polymer 2 with $M_w$ of 68368 Da.

Preparation of Inventive Composition 3 (EHAT:EAT:V13F, 20:40:40 by Wt)—in Toluene Process Inventive Composition 3 is prepared by thoroughly mixing 2-ethylhexyl acrylate (EHAT) (40.0 g), ethyl acrylate (EAT) (80.0 g), 3,3,4,4,5,5,6,6,7,7,8,8,8 tridecafluorooctyl acrylate (V13F) (80.0 g), and tert-butyl peroxy-2-ethylhexanoate (TBPE) (0.22 g) in a glass bottle. Then, 66.7 g of the monomer mixture along with 100.0 g of toluene are transferred to a IL round bottom flask equipped with a mechanical stirrer, Claisen adapter with water-cooled condenser and nitrogen inlet (set at 0.2 standard cubic feet per hours (scfh)), a thermocouple and stopper ("reaction vessel"). This mixture is heated to 90° C., and the remaining 133.3 g of the monomer mixture is added over 180 minutes via peristaltic pump and maintained at 90° C. for the duration of the addition. After all the monomer mixture is transferred to the reaction vessel, the reaction temperature is maintained at 90° C. for 180 min. Then the temperature is adjusted to 110° C., and TBPE (0.12 g) is added to the reaction vessel and held for 60 min. Similarly, three more TBPE (0.06 g) aliquots are charged and allowed to react for 60 min after each addition. Once complete monomer consumption is observed, 100.0 g toluene is added and stirred for 30 min. The reaction contents are cooled to give a solution containing a fluoro (poly)acrylate polymer 3 with Mw of 123101 Da.

Preparation of Inventive Composition 4 (EHAT:EAT:V13F, 42.5:42.5:15 by Wt)—in Toluene Process Inventive Composition 5 is prepared by thoroughly mixing 2-ethylhexyl acrylate (EHAT) (72.9 g), ethyl acrylate (EAT) (72.9 g), 3,3,4,4,5,5,6,6,7,7,8,8,8 tridecafluorooctyl acrylate (V13F) (25.8 g), toluene (171.6 g), and tert-butyl peroxy-2-ethylhexanoate (TBPE) (0.19 g) in a glass bottle. Then, 114.4 g of the mixture is transferred to a 0.5 L round bottom flask equipped with a mechanical stirrer, Claisen adapter with water-cooled condenser and nitrogen inlet (set at 0.2 standard cubic feet per hours (scfh)), a thermocouple and stopper ("reaction vessel"). This reaction mixture is heated to 110° C. Then the remaining 228.8 g of the mixture is added over 90 minutes via peristaltic pump and maintained at 110° C. for the duration of the addition. After all the monomer mixture is transferred to the reaction vessel, the reaction temperature is maintained at 110° C. for 90 min. Then TBPE (0.12 g) is added to the reaction vessel and held at 110° C. for 40 min. Similarly, three more TBPE (0.12 g) aliquots are charged and allowed to react for 40 min after each addition. Once complete monomer consumption is observed the reaction contents are cooled to give a solution containing a fluoro (poly)acrylate polymer 4 with Mw of 67721 Da.

Preparation of Inventive Composition 5 (EHAT:EAT:V13F, 75:23:02 by Wt)—in Toluene Process: (Prophetic Example)

Inventive Composition 5 is prepared by thoroughly mixing 2-ethylhexyl acrylate (EHAT) (128.7 g), ethyl acrylate (EAT) (39.5 g), 3,3,4,4,5,5,6,6,7,7,8,8,8 tridecafluorooctyl acrylate (V13F) (3.4 g), toluene (171.6 g), and tert-butyl peroxy-2-ethylhexanoate (TBPE) (0.19 g) in a glass bottle. Then, 114.4 g of the mixture is transferred to a 0.5 L round bottom flask equipped with a mechanical stirrer, Claisen adapter with water-cooled condenser and nitrogen inlet (set at 0.2 standard cubic feet per hours (scfh)), a thermocouple and stopper ("reaction vessel"). This reaction mixture is heated to 110° C. Then the remaining 228.8 g of the mixture is added over 90 minutes via peristaltic pump and maintained at 110° C. for the duration of the addition. After all the monomer mixture is transferred to the reaction vessel, the reaction temperature is maintained at 110° C. for 90 min. Then TBPE (0.12 g) is added to the reaction vessel and held at 110° C. for 40 min. Similarly, three more TBPE (0.12 g) aliquots are charged and allowed to react for 40 min after each addition. Once complete monomer consumption is observed the reaction contents are cooled to give a solution containing a fluoro(poly)acrylate polymer 5.

Preparation of Inventive Composition 6 (EHAT:EAT:V13F, 37.5:37.5:25 by Wt)—in Toluene Process Inventive Composition 6 is prepared by thoroughly mixing 2-ethylhexyl acrylate (EHAT) (64.4 g), ethyl acrylate (EAT) (64.4 g), 3,3,4,4,5,5,6,6,7,7,8,8,8 tridecafluorooctyl acrylate (V13F) (42.9 g), toluene (171.6 g), and tert-butyl peroxy-2-ethylhexanoate (TBPE) (0.19 g) in a glass bottle. Then, 114.4 g of the mixture is transferred to a 0.5 L round bottom flask equipped with a mechanical stirrer, Claisen adapter with water-cooled condenser and nitrogen inlet (set at 0.2 standard cubic feet per hours (scfh)), a thermocouple and stopper ("reaction vessel"). This reaction mixture is heated to 110° C. Then the remaining 228.8 g of the mixture is added over 90 minutes via peristaltic pump and maintained at 110° C. for the duration of the addition. After all the monomer mixture is transferred to the reaction vessel, the reaction temperature is maintained at 110° C. for 90 min. Then TBPE (0.12 g) is added to the reaction vessel and held at 110° C. for 40 min. Similarly, three more TBPE (0.12 g) aliquots are charged and allowed to react for 40 min after each addition. Once complete monomer consumption is observed the reaction contents are cooled to give a solution containing a fluoro (poly)acrylate polymer 6 with Mw of 60120 Da.

Preparation of Inventive Composition 7 (EHAT:EAT:V8FM, 71:23:7 by Wt)—in Toluene Process Inventive Composition 7 is prepared by thoroughly mixing ethyl acrylate (EAT) (41.8 g), 2-ethylhexyl acrylate (EHAT) (130.8 g), 1H,1H,5H-octafluoropentyl methacrylate (V8FM) (12.5 g), toluene (185.0 g), and tert-butyl peroxy-2-ethylhexanoate (TBPE) (0.20 g) in a glass bottle. Then, 123.5 g of the mixture is transferred to a IL round bottom flask equipped with a mechanical stirrer, Claisen adapter with water-cooled condenser and nitrogen inlet (set at 0.2 standard cubic feet per hours (scfh)), a thermocouple, a stopper and 0.5 L addition funnel ("reaction vessel"). This reaction mixture is heated to 110° C. Then the remaining 246.6 g of the mixture is added dropwise over 90 minutes to the flask via addition funnel and maintained at 110° C. for the duration of the addition. After all the monomer mixture is transferred to the reaction vessel, the reaction temperature is maintained at 110° C. for 60 min. Then TBPE (0.06 g) in toluene (2.5 g) is added to the reaction vessel and held at 110° C. for 60 min. Similarly, one more TBPE (0.06 g) in toluene (2.5 g) aliquot is charged and allowed to react for 120 min after the addition. Once complete monomer consumption is observed the reaction contents are cooled to room temperature and transferred to a IL round bottom flask. Then toluene is removed using rotary evaporator to obtain a viscus fluoro(poly)acrylate polymer 7 with Mw of 44667 Da. The polymer is blended with oil to be 40% actives.

Preparation of Inventive Composition 8 (EHAT:EAT:HFB, 54:31:15 by Wt)—in Toluene Process Inventive Composition 8 is prepared by thoroughly mixing ethyl acrylate (EAT) (62.0 g), 2-ethylhexyl acrylate (EHAT) (108.0 g), 2,2,3,4,4,4-hexafluorobutyl acrylate (HFB) (30.0 g), toluene (200.0 g), and tert-butyl peroxy-2-ethylhexanoate (TBPE) (0.22 g) in a glass bottle. Then, 133.3 g of the mixture is transferred to a 0.5 L round bottom flask equipped with a mechanical stirrer, Claisen adapter with water-cooled condenser and nitrogen inlet (set at 0.2 standard cubic feet per hours (scfh)), a thermocouple, a stopper and 0.5 L addition funnel ("reaction vessel"). This reaction mixture is heated to 110° C. Then the remaining 266.7 g of the mixture is added dropwise over 90 minutes to the flask via addition funnel and maintained at 110° C. for the duration of the addition. After all the monomer mixture is transferred to the reaction vessel, the reaction temperature is maintained at 110° C. for 60 min. Then TBPE (0.04 g) is added to the reaction vessel and held at 110° C. for 60 min. Similarly, three more TBPE (0.04 g) aliquots are charged and allowed to react for 60 min after each addition. Once complete monomer consumption is observed the reaction contents are cooled to room temperature and transferred to a IL round bottom flask. Then toluene is removed using rotary evaporator to obtain a viscus fluoro(poly)acrylate polymer 8 with Mw of 64122 Da.

Preparation of Inventive Composition 9 (TMHAT:EAT:HFB, 54:31:15 by Wt)—in Toluene Process Inventive Composition 9 is prepared by thoroughly mixing ethyl acrylate (EAT) (48.8 g), 3,5,5-trimethylhexyl acrylate (TMHAT) (85.0 g), 2,2,3,4,4,4-hexafluorobutyl acrylate (HFB) (23.6 g), toluene (157.0 g), and tert-butyl peroxy-2-ethylhexanoate (TBPE) (0.17 g) in a glass bottle. Then, 104.7 g of the mixture is transferred to a 0.5 L round bottom flask equipped with a mechanical stirrer, Claisen adapter with water-cooled condenser and nitrogen inlet (set at 0.2 standard cubic feet per hours (scfh)), a thermocouple and stopper ("reaction vessel"). This reaction mixture is heated to 110° C. Then the remaining 209.3 g of the mixture is added over 90 minutes to the flask via peristaltic pump and maintained at 110° C. for the duration of the addition. After all the monomer mixture is transferred to the reaction vessel, the reaction temperature is maintained at 110° C. for 60 min. Then TBPE (0.04 g) is added to the reaction vessel and held at 110° C. for 60 min. Similarly, three more TBPE (0.04 g) aliquots are charged and allowed to react for 60 min after each addition. Once complete monomer consumption is observed the reaction contents are cooled to room temperature and transferred to a IL round bottom flask. Then toluene is removed using rotary evaporator to obtain a viscus fluoro(poly)acrylate polymer 9 with Mw of 63842 Da.

Preparation of Inventive Composition 10 (EHAT:EAT:HFB, 71:23:7 by Wt)—in Toluene Process Inventive Composition 10 is prepared by thoroughly mixing ethyl acrylate (EAT) (67.8 g), 2-ethylhexyl acrylate (EHAT) (211.8 g), 2,2,3,4,4,4-hexafluorobutyl acrylate (HFB) (23.6 g), toluene (300.0 g), and tert-butyl peroxy-2-ethylhexanoate (TBPE) (0.33 g) in a glass bottle. Then, 200.0 g of the mixture is transferred to a 2 L round bottom flask equipped with a mechanical stirrer, Claisen adapter with water-cooled condenser and nitrogen inlet (set at 0.2 standard cubic feet per hours (scfh)), a thermocouple, and stopper ("reaction vessel"). This reaction mixture is heated to 110° C. Then the remaining 400 g of the mixture is added dropwise over 90 minutes to the flask via peristaltic pump and maintained at 110° C. for the duration of the addition. After all the monomer mixture is transferred to the reaction vessel, the reaction temperature is maintained at 110° C. for 60 min. Then TBPE (0.09 g) is added to the reaction vessel and held at 110° C. for 60 min. Similarly, three more TBPE (0.09 g) aliquots are charged and allowed to react for 60 min after each addition. Once complete monomer consumption is observed the reaction contents are cooled to room temperature and transferred to a IL round bottom flask. Then toluene is removed using rotary evaporator to obtain a viscus fluoro(poly)acrylate polymer 10 with $M_w$ of 46879 Da. The polymer is blended with oil to be 40% actives.

Silicon-containing antifoams are needed to obtain good initial foaming performance. However, in formulations containing phosphorus-containing antiwear agents and Si-based antifoams, hydrolysis of the phosphite can create acidic conditions that promote decomposition of the antifoam. This decomposition aggravates aged foam tendency.

The above poly(acrylate) polymers are added to a base-line lubricant suitable for use as an automatic transmission fluid ("ATF"). The ATFs are formulated to target 4 cSt and having the composition in the table below:

TABLE 7

| ATF Component | Amount (wt % on an actives basis) |
|---|---|
| Phosphite-containing antiwear agent | 0.26 |
| Si-containing anti-foam agent (ppm) | 55 ppm |
| Dispersant | 2.0-5.0 |
| Overbased Detergent | 0.1-0.5 |
| Antioxidant | 1.0-3.0 |
| Friction Modifier | 0.5-1.0 |
| Viscosity Modifier | 2.0-6.0 |
| Any Other Performance Additive | 1.0-5.0 |
| Oil of Lubricating Viscosity | Balance to 100 wt % |

The antifoam performance of each of the poly(acrylate) polymers above is evaluated in the base-line lubricant shown in Table 7 in accordance with ASTM D892-13e1 Standard Test Method for Foaming Characteristics of Lubricating Oils before (Pre-ISOT) and after (post-ISOT) the Indiana Stirrer Oxidation Test (ISOT) in which the fluid is oxidized and stressed in the presence of iron and copper coupons.

For the ASTM D892-13e1 there are three different sequence measurements, I, II and III. For Sequence I, the fluid is subjected to foam testing, in which a portion of the test sample is maintained at a bath temperature of 24±0.5° C. while air is blown through the sample at a constant flow rate of 94±5 mL/min for 5 minutes and then allowed to settle for ten minutes. The volume of foam is measured at the 5 and 10-minute periods and is referred to as the Sequence I measurement.

A second portion of the test sample is then tested according to sequence I, but at a bath temperature of 93.5±0.5° C. The volume of foam is then again measured. This is referred to as the Sequence II measurement.

Once any foam arising from Sequence II has collapsed, the same sample from Sequence II is allowed to stand in air & cooled to below 43.5° C. before placing the test cylinder in a bath maintained at 24±0.5° C. and subjecting the sample to the same air flow rate, blowing & settling duration as Sequence I. This is known as Sequence III.

In the ISOT test, a 250 mL test sample is stirred at 150° C. for 192 hours (or at 135° C. for 120 hours) in the presence of a copper coupon and an iron coupon to prepare a heat-treated fluid. Then Sequences I, II, and III, are repeated using the heat-treated fluid.

The D892 test results of the automatic transmission fluid having the poly(acrylate) polymers are shown in Table 8 below.

TABLE 8

| Example | ppm antifoam (actives) | State of Sample | Seq I | Seq II | Seq III |
|---|---|---|---|---|---|
| 1 - EHAT:EAT (85:15)[1] | 400 | pre-ISOT | 20 | 10 | 0 |
| (Comparative) | | post-ISOT | 350 | 30 | 340 |
| 2 - EAT:V13F (60:40) | 40 | pre-ISOT | 0 | 20 | 0 |
| | | post-ISOT | 10 | 30 | 10 |
| 3 - EHAT:EAT:V13F | 10 | pre-ISOT | 10 | 10 | 00 |
| (20:40:40) | | post-ISOT | 0 | 20 | 30 |
| 4 - EHAT:EAT:V13F | 100 | pre-ISOT | 0 | 0 | 0 |
| (42.5:42.5:15) | | post-ISOT | 10 | 10 | 10 |
| 6 - EHAT:EAT:V13F | 60 | pre-ISOT | 0 | 0 | 0 |
| (37.5:37.5:25) | | post-ISOT | 10 | 10 | 10 |
| 7 - EHAT:EAT:V8MF | 400 | pre-ISOT | 10 | 10 | 10 |
| (71:23:7)[1] | | post-ISOT | 0 | 0 | 0 |
| 7[2] - EHAT:EAT:V8MF | 100 | pre-ISOT | 30 | 10 | 10 |
| (71:23:7)[1] | | post-ISOT | 0 | 0 | 0 |
| 8 - EHAT:EAT:HFB | 400 | pre-ISOT | nr[3] | nr | nr |
| (54:31:15) | | post-ISOT | 0 | 0 | 0 |
| 9 - TMHAT:EAT:HFB | 400 | pre-ISOT | nr | nr | nr |
| (54:31:15) | | post-ISOT | 0 | 0 | 0 |
| 10 - EHAT/EAT/HFB | 400 | pre-ISOT | nr | nr | nr |
| (71:23:7)[1] | | post-ISOT | 10 | 20 | 0 |

[1]these tests were run after the samples were heat treat at 135 for 120 hours. All other samples were heat treated at 150 for 192 hours.
[2]The base-ATF formulation tested was as all the other examples, EXCEPT no silicon-containing anti-foam agent was added.;
[3]nr = not rated As can be seen in Table 8, the inventive examples comprising a fluoropolymer perform well in both the pre- and post-ISOT performance of foaming than the comparative without any fluoropolymer.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the term "comprising" is intended also to encompass as alternative embodiments "consisting essentially of" and "consisting of." "Consisting essentially of" permits the inclusion of substances that do not materially affect the basic and novel characteristics of the composition under consideration.

What is claimed is:

1. A lubricating composition comprising:

a) at least one oil of lubricating viscosity; and b) an antifoam component comprising a poly(acrylate) copolymer including:

(i) from about 40 wt % up to about 80 wt % of a (meth)acrylate monomer having $C_1$ to $C_4$ alkyl esters of (meth)acrylic acid; and (ii) from about 20 wt % up to about 60 wt % of a fluorinated (meth)acrylate monomer comprising at least one of 2,2,2-trifluoroethyl (meth)acrylate, 1,1,1,3,3,-hexafluoroisopropyl (meth)acrylate, 2,2,3,3,4,4,5,5-octafluoropentyl (meth)methacrylate, 3,3,4,4,5,5,6,6,7,7,8,8,9,9,10,10,10-heptadecafluoroundecyl (meth)acrylate, 2,2,3,4,4,4-hexafluorobutyl (meth) acrylate, 3,3,4,4,5,5,6,6,7,7,8,8,8-tridecafluorooctyl (meth)acrylate, or combinations thereof;

the antifoam component having a $M_w$ of at least 1,000 Daltons; and wherein the lubricating composition has a kinematic viscosity ("KV") at 100° C. of equal to or less than 5 cSt.

2. The lubricating composition of claim 1, wherein the (meth)acrylate monomer has $C_1$ to $C_3$ alkyl esters of (meth) acrylic acid.

3. The lubricating composition of claim 1, wherein the at least one oil of lubricating viscosity is a Group I oil, Group II oil, Group III oil, Group IV oil, Group V oil, or mixtures thereof.

4. The lubricating composition of claim 3, wherein the at least one oil of lubricating viscosity is a Group I oil, Group III oil, Group IV oil, Group V oil, or mixtures thereof.

5. The lubricating composition of claim 1, wherein the (meth)acrylate monomer (i) comprises ethyl (meth)acrylate or propyl (meth)acrylate.

6. The lubricating composition of claim 1, further comprising a phosphorus-containing anti-wear agent, a silicon-containing anti-foam agent, or combinations thereof.

7. The lubricating composition of claim 6, comprising dialkyl hydrogen phosphite, poly dialkylsiloxane, or combinations thereof.

8. The lubricating composition of claim 6, comprising dialkyl hydrogen phosphite, poly dialkylsiloxane, and/or fluorinated poly dialkylsiloxane.

9. The lubricating composition of claim 6, comprising dibutyl phosphite.

10. The lubricating composition of claim 1, wherein the (meth)acrylate monomer (i) is ethyl acrylate and the fluorinated (meth)acrylate monomer (ii) is 3,3,4,4,5,5,6,6,7,7,8,8,8-tridecafluorooctyl (meth)acrylate.

11. The lubricating composition of claim 1, wherein the antifoam component has a $M_w$ of from about 10,000 Da to about 350,000 Da.

12. The lubricating composition of claim 1, wherein the antifoam component is present in the lubricating composition in an amount of at least 1 ppm.

13. The lubricating composition of claim 1, further comprising at least one additive that is a dispersant, viscosity modifier, friction modifier, detergent, antioxidant, seal swell agent, anti-wear agent, or combinations thereof.

14. A method of lubricating a mechanical device comprising supplying to the mechanical device the lubricating composition of claim 1.

15. The method of claim 14, wherein the mechanical device comprises a driveline device.

16. The method of claim 15, wherein the driveline device comprises an axle, a gear, a gearbox or a transmission.

17. The method of claim 14 wherein the mechanical device comprises an internal combustion engine.

18. The method of claim 14, wherein the mechanical device comprises a hydraulic system, a turbine system, a circulating oil system, a refrigeration lubricant system, or an industrial gear.

19. A method of foam inhibition in a mechanical device comprising contacting the mechanical device with the lubricating composition of claim 1.

20. The method of claim 14 or 19, wherein the mechanical device comprises at least one silicon-containing gasket.

* * * * *